US011545757B2

(12) United States Patent
Bayat-Makou et al.

(10) Patent No.: US 11,545,757 B2
(45) Date of Patent: Jan. 3, 2023

(54) DUAL END-FED BROADSIDE LEAKY-WAVE ANTENNA

(71) Applicants: Nima Bayat-Makou, Montreal (CA); Ke Wu, Saint-Laurent (CA); Ahmed Abdelwahed Kishk, St-Hubert (CA)

(72) Inventors: Nima Bayat-Makou, Montreal (CA); Ke Wu, Saint-Laurent (CA); Ahmed Abdelwahed Kishk, St-Hubert (CA)

(73) Assignee: HUAWEK TECHNOLOGIES CANADA CO., LTD., Kanata (CA)

( * ) Notice: Subject to any disclaimer, the term of this patent is extended or adjusted under 35 U.S.C. 154(b) by 180 days.

(21) Appl. No.: 16/720,640

(22) Filed: Dec. 19, 2019

(65) Prior Publication Data

US 2020/0203845 A1 Jun. 25, 2020

Related U.S. Application Data

(60) Provisional application No. 62/782,228, filed on Dec. 19, 2018.

(51) Int. Cl.
*H01Q 13/28* (2006.01)
*H01Q 13/22* (2006.01)

(52) U.S. Cl.
CPC ..... *H01Q 13/28* (2013.01); *H01Q 13/22* (2013.01)

(58) Field of Classification Search
CPC .... H01Q 13/20; H01Q 13/203; H01Q 13/206; H01Q 13/22; H01Q 13/24; H01Q 13/26; H01Q 13/28
See application file for complete search history.

(56) References Cited

U.S. PATENT DOCUMENTS

2019/0273324 A1* 9/2019 Sasaki ..... H01Q 21/08

OTHER PUBLICATIONS

P. S. Kildal, "Combined E and H plane phase centers of antenna feeds," IEEE Trans. Antennas Propagat., vol. AP-31, No. 1, Jan. 1983.

R. Shavit and R. Elliott, "Design of transverse slot arrays fed by a boxed stripline," IEEE Trans. Antennas Propag, vol. 31, No. 4, pp. 545-552, Jul. 1983.

M. Ettorre, R. Sauleau, L. L. Coq, and F. Bodereau, "Single-Folded Leaky-Wave Antennas for Automotive Radars at 77 GHz," IEEE Antennas Wireless Propag. Lett., vol. 9, pp. 859-862, 2010.

(Continued)

*Primary Examiner* — Daniel Munoz

(57) ABSTRACT

A single-layer substrate integrated directive broadside beam leaky-wave antenna is provided. Opposite ends of a leaky-wave structure are fed with anti-phase versions of a common signal, resulting in broadside frequencies being set apart from the open stopband. To achieve this, the common signal can be split into two equal length paths, one including a perfect electrical conductor (PEC) reflector and the other including a perfect magnetic conductor (PMC) reflector. Alternatively, the common signal can be split into two paths which differ in length by a half wavelength. A power splitter and feed horns can be used in the respective paths. The leaky-wave structure may have transverse slots which increase in width toward a midpoint of the structure. The antenna can be formed in a single planar portion of a lithographic structure, for example by patterning an upper conductive layer thereof.

31 Claims, 24 Drawing Sheets

(56) References Cited

OTHER PUBLICATIONS

C. Luxey and J.-Laheurte, "Dual-beam array of microstrip leaky-wave antennas," Electronics Letters, vol. 34, No. 11, pp. 1041-1042, May 1998.
M. Ghomi and H. Baudrand, "Full-wave analysis of microstrip leaky-wave antenna," Electronics Letters, vol. 25, No. 13, pp. 870-871, Jun. 1989.
Y. Li, Q. Xue, H. Tan, and Y. Long, "The Half-Width Microstrip Leaky Wave Antenna With the Periodic Short Circuits," IEEE Trans. Antennas Propag, vol. 59, No. 9, pp. 3421-3423, Sep. 2011.
A. Grbic and G. V. Eleftheriades, "Leaky CPW-based slot antenna arrays for millimeter-wave applications," IEEE IEEE Trans. Antennas Propag, vol. 50, No. 11, pp. 1494-1504, Nov. 2002.
F. Xu, K. Wu, and X. Zhang, "Periodic Leaky-Wave Antenna for Millimeter Wave Applications Based on Substrate Integrated Waveguide," IEEE Trans. Antennas Propag, vol. 58, No. 2, pp. 340-347, Feb. 2010.
J. Xu, W. Hong, H. Tang, Z. Kuai, and K. Wu, "Half-Mode Substrate Integrated Waveguide (HMSIW) Leaky-Wave Antenna for Millimeter-Wave Applications," IEEE Antennas Wireless Propag. Lett., vol. 7, pp. 85-88, 2008.
Y. J. Cheng, W. Hong, K. Wu, and Y. Fan, "Millimeter-Wave Substrate Integrated Waveguide Long Slot Leaky-Wave Antennas and Two-Dimensional Multibeam Applications," IEEE Trans. Antennas Propag, vol. 59, No. 1, pp. 40-47, Jan. 2011.
M. Guglielmi, D. R. Jackson, "Broadside radiation from periodic leaky-wave antennas", IEEE Trans. Antennas Propag., vol. 41, No. 1, pp. 31-37, Jan. 1993.
R. Henry, M. Okoniewski, "A broadside scanning substrate integrated waveguide periodic phase-reversal leaky-wave antenna", IEEE Antennas Wireless Propag. Lett., vol. 15, pp. 602-605, 2016.
R. Henry and M. Okoniewski, "A Broadside Scanning Substrate Integrated Waveguide Periodic Phase-Reversal Leaky-Wave Antenna," IEEE Antennas and Wireless Propagation Letters, vol. 15, pp. 602-605, 2016.
N. Yang, C. Caloz, K. Wu, "Full-space scanning periodic phase-reversal leaky-wave antenna", IEEE Trans. Microw. Theory Techn., vol. 58, No. 10, pp. 2619-2632, Oct. 2010.
S. Paulotto, P. Baccarelli, F. Frezza, D. R. Jackson, "A novel technique for open-stopband suppression in 1-D periodic printed leaky-wave antennas", IEEE Trans. Antennas Propag., vol. 57, No. 7, pp. 1894-1906, Jul. 2009.
J. T. Williams, P. Baccarelli, S. Paulotto, D. R. Jackson, "1-D combline leaky-wave antenna with the open-stopband suppressed: Design considerations and comparisons with measurements", IEEE Trans. Antennas Propag., vol. 61, No. 9, pp. 4484-4492, Sep. 2013.
P. Baccarelli, C. Di Nallo, S. Paulotto, D. R. Jackson, "A full-wave numerical approach for modal analysis of 1-D periodic microstrip structures", IEEE Trans. Microw. Theory Techn., vol. 54, No. 4, pp. 1350-1362, Jun. 2006.
S. Otto, A. Rennings, K. Solbach, C. Caloz, "Transmission line modeling and asymptotic formulas for periodic leaky-wave antennas scanning through broadside", IEEE Trans. Antennas Propag., vol. 59, No. 10, pp. 3695-3709, Oct. 2011.
J. S. Gomez-Diaz, D. Canete-Rebenaque, A. Alvarez-Melcon, "A simple CRLH LWA circuit condition for constant radiation rate", IEEE Antennas Wireless Propag. Lett., vol. 10, pp. 29-32, 2011.
S. Paulotto, P. Baccarelli, F. Frezza, D. R. Jackson, "Full-wave modal dispersion analysis and broadside optimization for a class of microstrip CRLH leaky-wave antennas", IEEE Trans. Microw. Theory Techn., vol. 56, No. 12, pp. 2826-2837, Dec. 2008.
M. Ettorre, A. Neto, G. Gerini, and S. Maci, "Leaky-Wave Slot Array Antenna Fed by a Dual Reflector System," IEEE Trans. Antennas Propag, vol. 56, No. 10, pp. 3143-3149, Oct. 2008.
E. Gandini, M. Ettorre, M. Casaletti, K. Tekkouk, L. L. Coq, and R. Sauleau, "SIW Slotted Waveguide Array With Pillbox Transition for Mechanical Beam Scanning," IEEE Antennas and Wireless Propagation Letters, vol. 11, pp. 1572-1575, 2012.
Ma Zi Long et al , A Collimated Surface-Wave-Excited High-Impedance Surface Leaky-Wave Antenna, IEEE Antennas and Wireless Propagation Letters, vol. 16, Apr. 24, 2017 (Apr. 24, 2017), XP011657924, pp. 2082-2085, total 4 pages.
Bayat-Makou Nima et al, Dual-layer substrate integrated broadside leaky-wave antenna, Global Symposium On Millimeter-Waves (GSMM), IEEE, May 25, 2015 (May 25, 2015), XP032846825, pp. 1-3, total 3 pages.
Gupta Shulabh et al, Magnetoelectric Dipole Antenna Arrays, IEEE Tran Sa Cti Ons On Antennas and Propagation, IEEE, USA, vol. 62, No. 7, Apr. 30, 2014 (Apr. 30, 2014), XP011552800, pp. 3613-3622, total 10 pages.
Yuanxin Li et al, Properties of a microstrip leaky-wave antenna with two-terminal feeding, IEEE Antennas and Propagation Society International Symposium. 2003 Digest. APS. Columbus, OH, Jun. 22-27, 2003; [IEEE Antennas and Propagation Society, International Symposium], New York, NY IEEE, US, Jun. 22, 2003 (Jun. 22, 2003), XP032413411, pp. 1150-1153, total 4 pages.

* cited by examiner

DUAL END-FED BROADSIDE LEAKY-WAVE ANTENNA

CROSS-REFERENCE TO RELATED APPLICATIONS

This application claims priority of U.S. Provisional Patent Application Ser. No. 62/782,228, entitled "Dual End-Fed Broadside Leaky-Wave Antenna" filed Dec. 19, 2019, the contents of which are incorporated herein by reference.

FIELD OF THE INVENTION

The present invention pertains to the field of leaky-wave antennas and in particular to a dual end-fed broadside leaky-wave antenna, such as a single-layer substrate integrated broadside leaky-wave antenna with long slot array and embedded reflector.

BACKGROUND

Leaky-wave antennas (LWA) have a history of use as inexpensive antennas in implementations in which there is a need for directive beams. In such implementations LWAs may be implemented without need for a complicated feeding network of radiating elements. LWA make use of a simple geometry to excite a number of elements to reach a scanning directive radiation pattern. However, existing leaky wave antennas suffer from a significant problem at broadside frequencies. Operation of an LWA at broadside frequencies has typically been associated with a loss of gain attributable to the creation of a standing wave inside the leaky waveguide structures. This open stopband problem is a recognized impediment to the use of LWA. It would be desirable to overcome such problems so that LWA can be effectively used, for example in the fifth generation (5G) wireless communication systems as well as other applications.

In the last decade, some methods have been investigated to modify the periodic cells of the leaky structures in order to mitigate the open stopband problem, and such modifications may enable the modified LWA to radiate efficiently at broadside frequencies. Unfortunately, these previously proposed solutions result in a complicated antenna structure.

In the conventional designs of waveguide-based periodic LWA structures, the periodic cell dimensions are limited in the transverse direction because of excitation waveguide limitations. Therefore, in order to reach a narrow beam width in the antenna both planes, the leaky structure has to be repeated in the transverse direction to make a 2D array configuration which requires adding power dividing circuits at the beginning and end of guiding lines. As the result increase the complexity of the antenna structure.

Accordingly, the previously proposed solutions are not optimal in all parts of the frequency spectrum, especially at higher frequency bands, and are subject to improvement. Therefore there is a need for new leaky-wave guiding structures and leaky-wave antennas that are not subject to one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

An object of the present invention is to provide a leaky wave antenna which is fed from two opposing ends and operable with a broadside radiation pattern. Another object of embodiments of the present invention is to provide a simple and single layer leaky-wave antenna which enables any periodic leaky structures to provide a broadside radiation pattern outside of its physical stopband. The periodic leaky structures may provide the broadside radiation pattern while the pattern reaches its broadside frequency.

In accordance with embodiments of the present invention, there is provided an antenna having: a leaky wave structure having a first end and a second end opposite the first end; and a feeding system comprising a first part and a second part. In some embodiments, the first part may include an approximately perfect electrical conductor (PEC) reflector. The first part is configured to direct a first signal to or from the first end of the leaky wave structure. The second part configured to direct a second signal to or from the second end of the leaky wave structure, the second signal being an anti-phase (e.g. approximately or exactly 180 degrees out of phase) version of the first signal. This is also referred to as the second signal being half-cycle shifted relative to the first signal. The first and second signals may be realized as plane waves in various embodiments.

In some embodiments, the first part of the feeding system includes a first reflector formed as an approximately perfect electrical conductor (PEC); and the second part comprises a second reflector formed as an approximately perfect magnetic conductor (PMC). In further embodiments, the first signal and the second signal originate or terminate at a common feed point of the antenna; a total path length of the first part, between the feed point and the first end of the leaky wave structure is equal to a total path length of the second part, between the feed point of the antenna and the second end of the leaky wave structure; and the second signal is caused to be the anti-phase version of the first signal due to inherently different operating properties of the PEC reflector relative to the PMC reflector. That is, the use of PEC and PMC reflectors provides for the anti-phase nature of the two signals. In some embodiments, instead of equal path lengths, the path lengths may differ by an integer multiple of an operating wavelength of the antenna. In some embodiments, the first (PEC) reflector is spaced apart from the first end of the leaky wave structure by a first distance; and the second (PMC) reflector is spaced apart from the second end of the leaky wave structure by a second distance. The first distance may be equal to the second distance, or the first distance may differ from the second distance by an integer multiple of an operating wavelength of the antenna.

In some embodiments, the antenna is formed from a layered structure having an upper conductive layer, a lower conductive layer, and a dielectric layer (substrate) between the upper conductive layer and the lower conductive layer. The PEC reflector may be formed by creating a conductive boundary in an internal portion of the layered structure. For example, a via fence, or a series of internally metallized drilled slots (e.g. rectangular cubes) passing from the upper conductive layer to the lower conductive layer (and separated by narrow gaps) may be used to define the PEC reflector. The PMC reflector may be provided by cutting a shaped (e.g. parabolic) boundary through all layers of the layered structure. A region absent of layered structure (i.e. a void) is thereby formed on one side of the PMC reflector boundary. The PMC reflector may be provided as a shaped boundary formed in the layered structure. The region absent of layered structure may be located on one side of the shaped boundary. The PEC reflector may be provided by a pattern of plated vias or slots having conductive boundaries and formed within an interior of the layered structure, passing from the upper conductive layer to the lower conductive layer. The PEC reflector and the PMC reflector may be curved reflectors.

In some embodiments, the first part of the feeding system includes a first reflector formed as an approximately perfect electrical conductor (PEC); and the second part includes a second reflector formed as another approximately perfect electrical conductor (PEC). The first and second reflectors are spaced apart from the first and second ends, respectively, of the leaky wave structure by a first distance and a second distance. The first distance may be greater than the second distance by one half of an operating wavelength of the antenna, or the first distance may differ from the second distance by an integer multiple of the operating wavelength minus one half of the operating wavelength. This half wavelength difference provides for the anti-phase nature of the first and second signals.

More generally, in some embodiments, the first part includes a first reflector, and the second part includes a second reflector. The first reflector and the second reflector are both formed as approximately perfect electrical conductors (PEC), or the first reflector and the second reflector are both formed as approximately perfect magnetic conductors (PMC). Additionally, a total path length of the first part, between a feed point of the antenna and the first end of the leaky wave structure is greater, by one half of an operating wavelength, than a total path length of the second part, between the feed point of the antenna and the second end of the leaky wave structure.

In various embodiments, the leaky wave structure includes a waveguide having a plurality of slots formed therein. The slots may be transverse to a main axis extending between the first end and the second end. In embodiments, the widths of the slots progressively increase toward a location of the leaky wave structure midway between the first end and the second end. The slots may alternatively be diagonally transverse to the main axis extending between the first end and the second end. When the slots are diagonally transverse to the main axis, at least two of the slots may be diagonally transverse in different directions, and cross one another. This arrangement can be referred to as crossed diagonally transverse.

In various embodiments, the antenna further includes a feed point for coupling the antenna to a transmission line, and a power divider coupled to the feed point. The feed point is configured to convey a common signal to or from the antenna. In such embodiments, the first part of the feeding system includes: a first arm of the power divider; a first feed horn coupled to the first arm; and a first reflector coupled to the first feed horn. The second part of the feeding system includes: a second arm of the power divider; a second feed horn coupled to the second arm; and a second reflector coupled to the second feed horn. A first portion of the common signal may be routed, via the first part, between the feed point and the first reflector. A second portion of the common signal may be routed, via the second part, between the feed point and the second reflector. The first portion and the second portion of the common signal are in phase with one another. The first portion of the common signal generates or is derived from the first signal. The second portion of the common signal generates or is derived from the second signal. The positioning, configuration, or both, of the first reflector and the second reflector, are configured to cause the second signal to be the approximately anti-phase version of the first signal. The feed point may convey the common signal to or from the antenna using both the first part and the second part of the feeding system.

In various embodiments, the leaky wave structure, the first part, and the second part, are all formed in a common planar portion of a lithographic layer structure. For example, the common planar portion may be formed from an upper conductive layer, a lower conductive layer, and a dielectric layer between the upper conductive layer and the lower conductive layer, and the leaky wave structure, the first part, and the second part may be provided by patterning of at least the upper conductive layer, and typically patterning of all layers, e.g. by cutting edges therein, forming conductive boundaries therein, etc.

In various embodiments, the feed point, the power divider, the leaky wave structure, the first part, and the second part, are all formed in a common layer of a lithographic layer structure.

BRIEF DESCRIPTION OF THE FIGURES

Further features and advantages of the present invention will become apparent from the following detailed description, taken in combination with the appended drawings, in which.

It will be noted that throughout the appended drawings, like features are identified by like reference numerals.

DETAILED DESCRIPTION

In the following discussion, antenna operation is primarily described with respect to a transmitting mode, in which a signal is provided at an antenna feed point and transmitted away from the antenna by a leaky wave structure. However, this focus on the transmitting mode is used for purposes of clarity only. It should be readily understood that the antenna described herein can also be used as a receiving antenna, in which a signal is received by the leaky wave structure and propagated to the antenna feed point.

Figure 1:
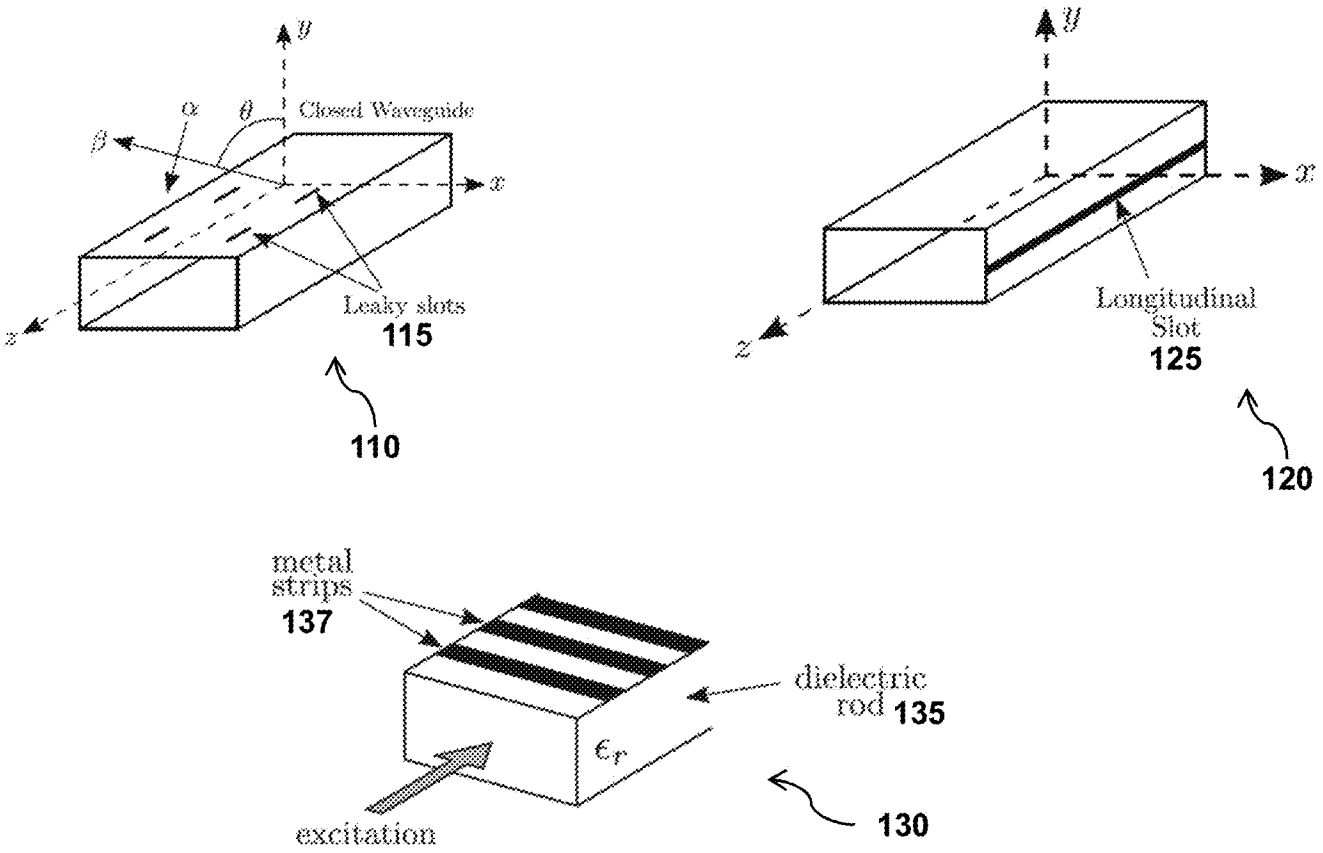
FIG. 1 (PRIOR ART)
FIG. 1 illustrates three prior art leaky-wave antennas which suffer from a considerable gain loss at their broadside frequencies.

FIG. 1 illustrates three conventional leaky-wave antennas. Antennas of such designs often suffer from a considerable gain loss at their broadside frequencies. The leaky-wave antenna 110 is a slotted rectangular waveguide leaky-wave antenna, including leaky slots 115. The leaky-wave antenna 120 is a rectangular waveguide with a longitudinal slot 125 on its side wall. The leaky-wave antenna 130 is a dielectric rod 135 which is periodically loaded with metallic strips 137.

The conventional LWAs 110, 120 and 130 typically exhibit a considerable gain loss at their broadside frequencies. This loss can be attributed to the large standing wave inside the leaky guiding structure when the LWAs are scanning through the broadside direction. Therefore, the conventional LWAs 110, 120 and 130 cannot be effectively utilized for the applications where fixed broadside radiation is required. The loss is also exhibited as a high reflection coefficient (S11 parameter) for signals injected into the antenna feed point.

Embodiments of the present invention provide a LWA embedded with PEC (Perfect Electric Conductor) and/or PMC (Perfect Magnetic Conductor) integrated reflectors. The PEC and/or PMC integrated reflectors may be utilized to excite a series of leaky wave long slot arrays from both sides of the leaky waveguide structure of the LWA. The excitation from both sides results in the LWA having a broadside radiation pattern at a frequency which is at least partially removed from the open stopband. The proposed configuration enables the leaky-wave structure to radiate to broadside outside of its open stopband region. Moreover, the PMC-like embedded reflector is introduced and realized in the proposed innovation.

Although the terms PEC and PMC are used herein, it should be understood that these terms are used for clarity only, and the reflectors are not necessarily made of "perfectly" electrically/magnetically conductive material. Rather, a PEC reflector may be a metallic (e.g. copper) conductor, while a PMC reflector may be formed by cutting an edge of a double-grounded substrate layer. The terms PEC and PMC may be understood herein to mean "approximately PEC" and "approximately PMC."

In conventional designs of LWAs, to achieve a broadside radiation pattern, complicated periodic cell configurations have been used to make the standing power radiate at open stop bandwidth. These structures increase the complexity of the LWA. In addition, this approach cannot be generalized to all type of radiating cells. In previous designs, obtaining a high gain fixed radiation pattern with the planar structures has required an array structure with a complicated feeding network.

According to embodiments of the invention, unlike conventional methods, a high gain directive fixed beam may be achieved without requiring the use of a complicated mechanism. In various embodiments of the present invention, by exciting the leaky radiating elements from both sides, a high gain broadside beam can be achieved over a bandwidth. The excitation may be achieved using plane waves which are reflected towards the opposing ends of the leaky-wave structure by a pair of integrated reflectors. The antenna is configured (e.g. by configuration or placement of the reflectors, or by configuration of path lengths traversed by the plane waves), to adjust the two reflected plane waves so that they have a half-cycle phase shift relative to each other (i.e. are in anti-phase) when they reach the radiating array of elements.

More generally, according to embodiments of the present invention, in an antenna, a leaky-wave structure, or another periodic structure, is excited from both sides simultaneously, with the two excitations being in anti-phase or having another appropriate phase difference. This may be used to obtain a broadside radiation pattern in a leaky-wave antenna, or to obtain another fixed, tilted high gain radiation pattern instead of a broadside radiation pattern.

According to embodiments, a periodic leaky wave radiating structure is excited from both sides simultaneously with identical excitation sources which have a half-cycle phase shift relative to each other. In fact, a simple concept of wave propagation is used based on this concept. If two opposite directed traveling waves with 180 degrees of phase shift meet each other, the two waves add together in the broadside. As such, the antenna is provided with a single directive beam. However, if the oppositely directed waves are in phase, they would create a null at the broadside.

According to embodiments, the high gain antenna (LWA) may include non-resonant long radiating slots which are arranged periodically to reach a narrow beamwidth radiation pattern. In various embodiments, the transverse length of slots provides the H-plane with a narrow beam width while the repetition of slots makes the E-plane narrow beam which finally reaches a pencil beam radiation pattern. In various embodiments, the leaky wave slot cells are extended in the transverse direction. This provides the leaky wave antenna with the narrow beam in H-plane, without repeating the leaky waveguide, by using power dividing circuits.

Leaky wave antennas are well known in the art in various forms. However, as discussed above, traditional leaky wave antennas suffer from a performance problem when excited at broadside frequencies. Broadside frequencies are generally defined as signal operating frequencies which result in a main lobe of the antenna radiation pattern being normal to the surface of the leaky wave antenna. These are contrasted with scanning frequencies, which result in the main lobe being at a non-perpendicular angle to the surface. In particular, at broadside frequencies, a standing wave can develop within the leaky wave antenna structure, resulting in a high value for the antenna reflection coefficient (S11). That is, the broadside frequencies typically overlap with an open stopband of the leaky wave structure, at which antenna operation is inefficient.

It has been recognized by the inventors that a leaky wave antenna structure can alternatively be driven by feeding a first signal into a first end of the leaky wave structure, and feeding a second signal, being an anti-phase version of the first signal, into a second end of the leaky wave structure opposite to the first end. The term anti-phase, referring to two signals, is generally taken to mean that one signal is approximately or exactly 180° out of phase of the other signal. The superposition of the first and second signals can then be radiated by the leaky wave structure. It has further been recognized by the inventors that such a configuration can help to extract a broadside radiation pattern from the leaky wave structure before entering its open stopband, allowing for the antenna to be more effectively used in the broadside regime. However, the low-gain broadside radiation still can occur at the open stopband frequencies.

A variety of approaches can be used to feed the leaky wave structure at opposing ends and in anti-phase. Embodiments of the present invention generally use an approach in which a common signal, presented at an antenna feed point, is split into two (e.g. approximately equal) parts. The two parts are routed along two different paths toward the first and second ends, respectively, of the leaky wave structure. The paths may include curved portions, and structures, such as reflectors, power dividers, and feed horns (e.g. H-plane horns) may be provided and cooperatively configured in order to implement the path curvature. The reflectors may be curved reflectors, for example parabolic reflectors. The structures providing the two paths are referred to herein as a first part and a second part, respectively, of a feeding system. The first and second parts can also be referred to, for clarity and without loss of generality, as the right and left sides of the feeding system. Where part of the common signal traversing the first path is fed to (e.g. reaches) the first end of the leaky wave structure, it is referred to as a first signal. Similarly, where part of the common signal traversing the second path is fed to (e.g. reaches) the second end of the leaky wave structure, it is referred to as a second signal. This nomenclature is used so that the end parts of the common signal can be referred to clearly, while allowing for signal phase shifting to (potentially) occur elsewhere in the first and second parts of the feeding system. The first and second parts of the feeding system are generally configured to modify their respective portions of the common signal so that the first and second signals are in anti-phase.

In some embodiments, modifying the respective portions of the common signal to provide the first and second signals in anti-phase is performed as follows. The two paths are made to be equal in length, or alternatively differing in length by an integer multiple of an operating wavelength of the antenna. The operating wavelength can refer to the wavelength corresponding to a center radio communication frequency, for example. The equality in path length may be provided to a level of precision which is at least on the order of the operating wavelength. The path lengths may be provided at least in part by spacing the first reflector from the first end of the leaky wave structure by a first distance, and spacing the second reflector from the second end of the leaky wave structure by a second distance, where the first and second distances are equal or differ by an integer multiple of the operating wavelength.

In addition, the first part of the feeding system includes a first reflector formed as an approximately perfect electrical conductor (PEC), while the second part of the feeding system includes a second reflector formed as an approximately perfect magnetic conductor (PMC). These reflectors can be directly coupled to the opposing first and second ends of the leaky wave structure. It has been recognized by the inventors that, due to the inherently different operating properties of PEC and PMC reflectors, the PMC reflector will impart a 180° phase reversal relative to the PEC reflector, thus providing the desired anti-phase property between the first and second signals.

In some embodiments, the first reflector is a PEC reflector, the second reflector is a PMC reflector, and the path traversed by the first portion of the common signal (including the first signal) is approximately equal in length to the path traversed by the second portion of the common signal (including the second signal). In such an embodiment, the first and second signals are expected to arrive at the leaky wave structure in anti-phase regardless of operating frequency. As such, the signals should be substantially in anti-phase not only at the center operating frequency but also for frequencies around the center operating frequency. This may improve antenna operation across a given frequency band.

In other embodiments, modifying the respective portions of the common signal to provide the first and second signals in anti-phase is performed by precise construction of the antenna so that the two paths are different in length either by one half of the operating wavelength, or by an integer multiple of the operating wavelength minus one half of the operating wavelength. This will cause the two parts of the common signal to be presented to the leaky wave structure as the anti-phase first and second signals.

In some embodiments, the first and second parts of the feeding system respectively include first and second reflectors, which are both PEC reflectors, or which are both PMC reflectors. The path length difference may be implemented by spacing the first reflector apart from the first end of the leaky wave structure by first distance, and spacing the second reflector apart from the second end of the leaky wave structure by a second distance, where the first distance is greater than the second distance by one half of an operating wavelength of the antenna, or wherein the first distance differs from the second distance by an integer multiple of the operating wavelength minus one half of the operating wavelength. The path lengths between the two reflectors and the antenna feed point can then be equal, or can differ by an integer multiple of the operating wavelength.

In some embodiments, in order to achieve the above-described half-wavelength difference in path lengths, the leaky wave structure is shifted by one quarter wavelength toward one of the two reflectors, compared to an alternative configuration in which the leaky wave structure is exactly centred between the two reflectors.

The path length difference is not necessarily limited to the portion of the path between reflector and leaky-wave structure. Rather, the path lengths between the two reflectors and the antenna feed points can differ in order to provide for some or all of the required (e.g. half-wavelength) path length difference. For example, in some embodiments, and in contrast to a different reference configuration (in which the leaky wave structure is exactly centred between the two reflectors), one of the PEC reflectors can be shifted outward by a quarter of an operating wavelength (without shifting or extending the associated feed horn). This causes a quarter wavelength increase in distance between the reflector and the leaky wave structure, as well as a quarter wavelength increase in distance between the feed horn and the reflector. These two increases constitute a half-wavelength increase in the path length. In other words, the leaky wave structure (e.g. slots) will not be centered between the PEC reflectors, but rather one of the PEC reflectors is shifted outwards to increase the total path length involving that PEC reflector.

According to various embodiments, the various components of the antenna, including the leaky wave structure, the first and second parts of the feeding system, and additional components such as feed horns, power divider, and antenna feed point structure, are all formed in a common planar portion of a lithographic layer structure. As such, these components are coplanar, which can simplify antenna design and fabrication. This common planar portion can be formed from layered structure having an upper conductive layer, a lower conductive layer, and a dielectric layer between the upper conductive layer and the lower conductive layer. At least the upper conductive layer (and possibly also the lower and dielectric layers) may be patterned (by removal of material) to form the antenna features described herein.

The patterning may include forming conductive boundaries within an internal portion of the layered structure. The conductive boundaries may be formed as a series (fence) of plated vias, or a similar structure. In particular, a series of closely spaced apertures (cut regions) can be drilled or otherwise formed in the layered structure. The cut regions may be rectangular cubes or rectangular prisms, or metallized cylindrical prisms, for example. Neighbouring ones of these cut regions are separated from one another by small gaps or distances. The apertures can be aligned end-to-end to define the desired boundary. The apertures may then be internally plated and metallized with conductive material to form a conductive boundary which is surrounded on both sides by the layered structure. Such a structure is similar to a via fence, but with the via apertures being replaced with apertures which are greater in size length-wise in the direction of the boundary. A PEC reflector can be formed in this manner, for example as a parabolic shaped boundary.

The patterning may include removing larger portions of the layered structure (or one or more layers thereof) to create regions absent of conductive material (voids) on one side of a shaped boundary. For example, a shaped boundary may be cut into the layered structure to form a (e.g. parabolic) shaped edge of the layered structure, which may be provided as a PMC reflector.

In some embodiments, a PMC reflector can be provided as a (e.g. parabolic) shaped boundary formed in the layered structure, with a region absent of layered structure (i.e. a void) being located on one side of the shaped boundary, and the layered structure thus terminating at the shaped boundary.

In some embodiments, by increasing the dielectric constant of the substrate material, the PMC boundary condition can be intensified. In other words, the approximate PMC reflector can become closer to an ideal PMC reflector if a substrate with a higher dielectric constant and smaller thickness is used for the antenna design. Embodiments of the present invention utilize a substrate (dielectric layer) with a dielectric constant of 2.94 (RO6002) which can be replaced with other laminates such as RO6010 with dielectric constant of 10.2 to potentially improve PMC reflector. It should be noted that, as the material changes, other design parameters and dimensions may need to be re-derived.

In some embodiments, the leaky wave structure can be provided in the form of a waveguide having a plurality of slots formed in a top face thereof. The leaky wave structure may be a periodic structure. The waveguide is defined by a main axis extending between the first end and the second end, with a midpoint being midway between the first end and the second end. The slots may be generally transverse to the main axis. In various embodiments, widths of the slots progressively increase toward the midpoint of the waveguide. That is, slots situated closer to the first and second ends may be narrower, whereas slots situated closer to the midpoint may be wider. This configuration, also referred to herein as tapered slot widths, may facilitate a concentration of radiated power toward the midpoint of the waveguide, particularly when operated at broadside frequencies. In some embodiments, the slot widths can be determined based on calculations described elsewhere herein. In other embodiments, when the leaky wave structure is provided as a dielectric periodically loaded with conductive strips, the widths of the conductive strips can progressively increase toward the midpoint of the leaky wave structure in much the same manner as the slots described above.

More generally, it should be understood that the leaky wave structure can be one of a variety of known structures, such as but not necessarily limited to a transversely slotted waveguide; a longitudinally slotted waveguide; a dielectric periodically loaded with conductive strips; and a series fed antenna array.

Figure 8A:
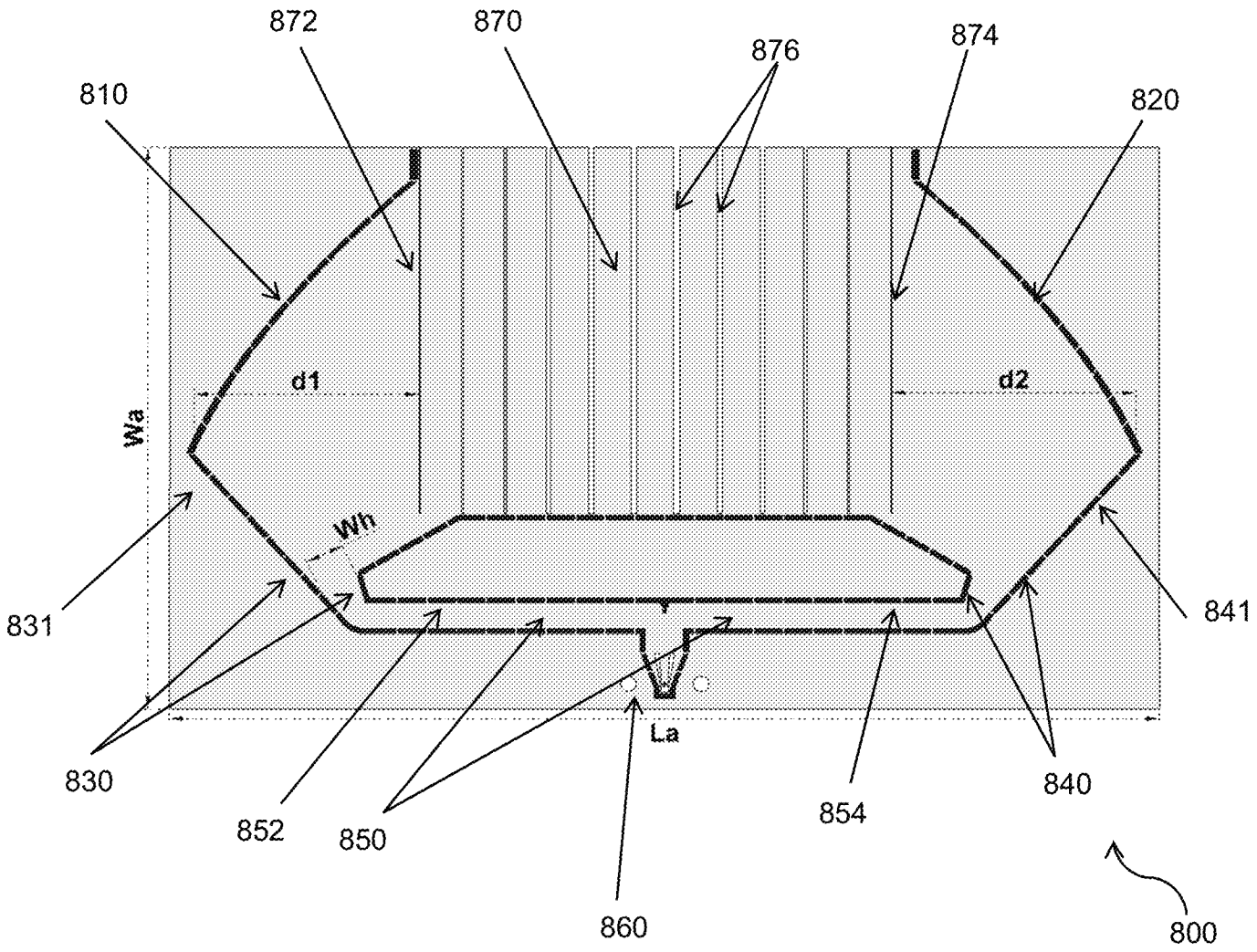
FIG. 8A illustrates a proposed LWA with a pair of integrated PEC reflectors and horns including the long radiating slots with the tapered widths, in accordance with embodiments of the present invention.
Figure 9:
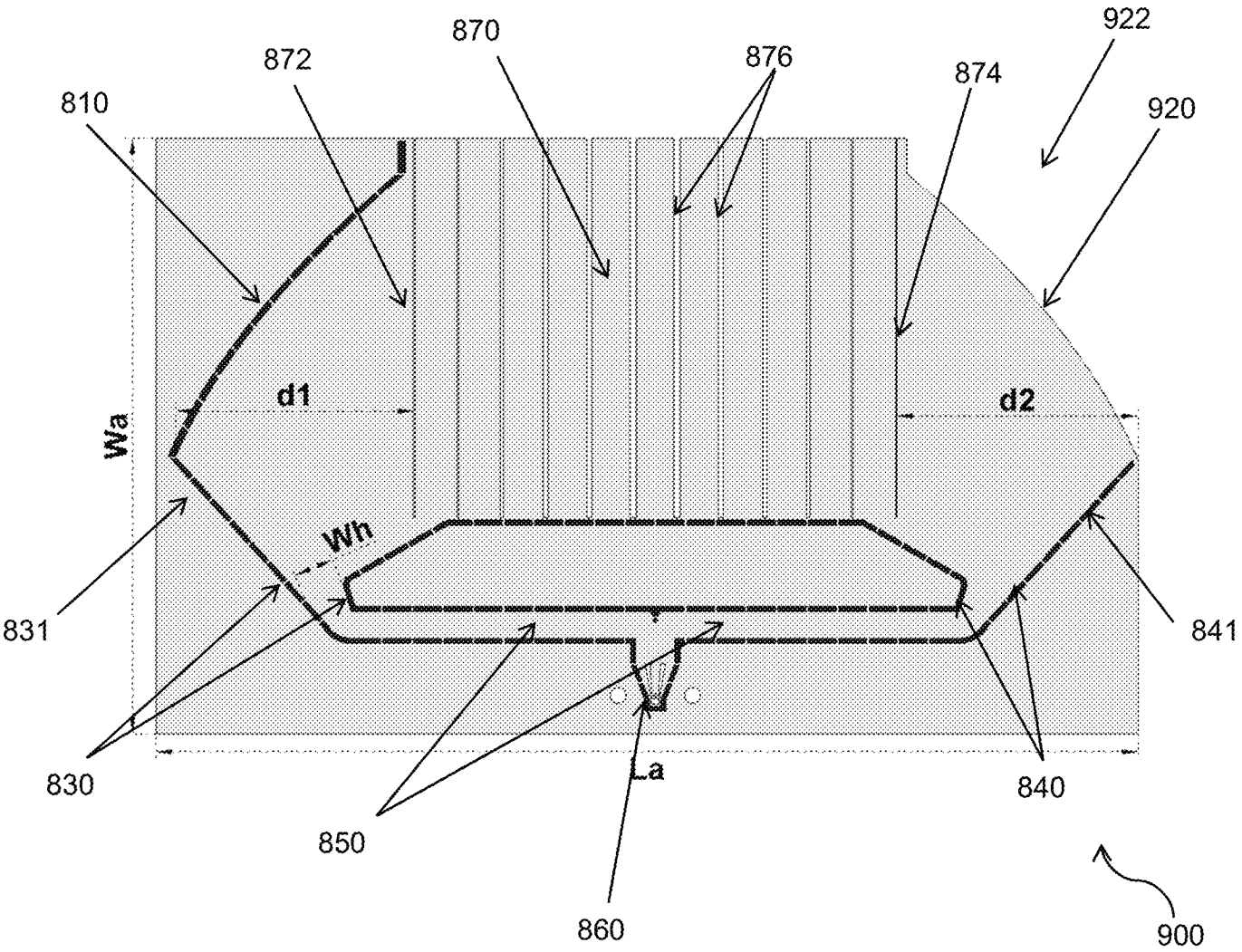
FIG. 9 illustrates another proposed LWA with the integrated PEC and PMC reflectors, in accordance with embodiments of the present invention.

According to various embodiments of the invention, and as illustrated for example in FIGS. 8A and 9, the antenna may include a feed point (e.g. 860) for coupling the antenna to a transmission line (such as but not necessarily a coaxial transmission line), and a power divider (e.g. 850) coupled to the feed point. The feed point is configured to convey a common signal to or from the antenna, while the power divider splits the common signal into two parts (for transmission) or merges two parts of the common signal (for reception). The power divider includes two arms (also referred to as two halves of the power divider). The first part of the feeding system includes a first arm (e.g. 852) of the power divider; a first feed horn (e.g. 830) coupled to the first arm; and a first reflector (e.g. 810) coupled to the first feed horn. Similarly, the second part of the feeding system includes a second arm (e.g. 854) of the power divider; a second feed horn (e.g. 840) coupled to the second arm; and a second reflector (e.g. 820) coupled to the second feed horn.

In various embodiments, in operation, a first portion of the common signal is routed, via the first part of the feeding system, between the feed point and the first reflector. Concurrently, a second portion of the common signal is routed, via the second part of the feeding system, between the feed point and the second reflector. In various embodiments, at this point, the first portion and the second portion of the common signal may be in phase with one another. Furthermore, the first portion of the common signal generates or is derived from the first signal, while the second portion of the common signal generates or is derived from the second signal. Furthermore, the positioning, configuration, or both, of the first reflector and the second reflector, may be configured to cause the second signal to be the 180° phase shifted, anti-phase version of the first signal. This configuration or positioning may be as already described above.

Figure 2A:
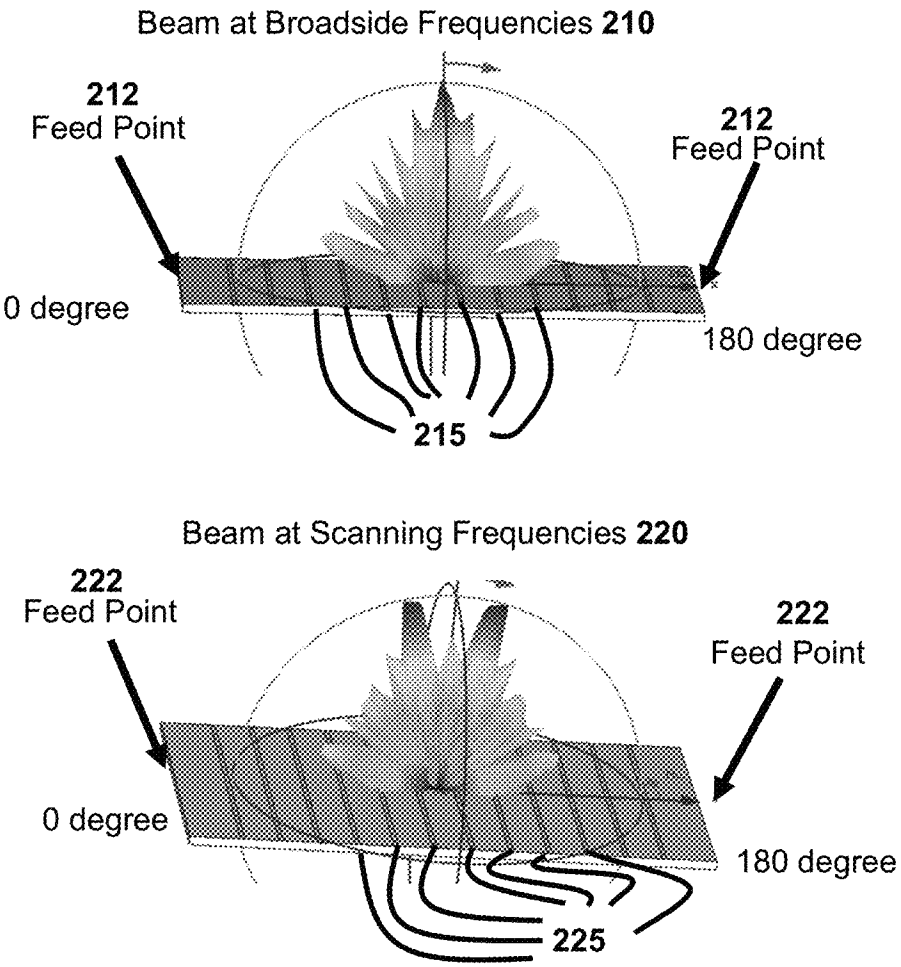
FIG. 2A illustrates beams at broadside frequencies and scanning frequencies produced by leaky-wave periodic slots excited from both sides, in accordance with embodiments of the present invention.

FIG. 2A illustrates beams 210, 220 at broadside frequencies (beam 210) and scanning frequencies (beam 220) produced by leaky-wave periodic slots 215 and 225 excited from both sides, in accordance with embodiments of the present invention. As illustrated, the broadside radiation pattern (of beam 210) has a main axis which is substantially normal to the leaky-wave antenna surface. At scanning frequencies, the radiation pattern (of beam 220) exhibits two lobes, each having a respective axis which forms a non-perpendicular angle with the leaky-wave antenna surface. The structures are excited at feed points 212, 222.

According to embodiments, in order to reach a broadside radiation pattern from leaky wave antennas, the leaky wave cell structure may be modified to make part of the standing power radiate at the antenna broadside frequencies. Feeding the leaky structure from both sides with phase-shifted waves may provide the leaky wave structure with broadside radiating power outside of its stop bandwidth.

Figure 2B:
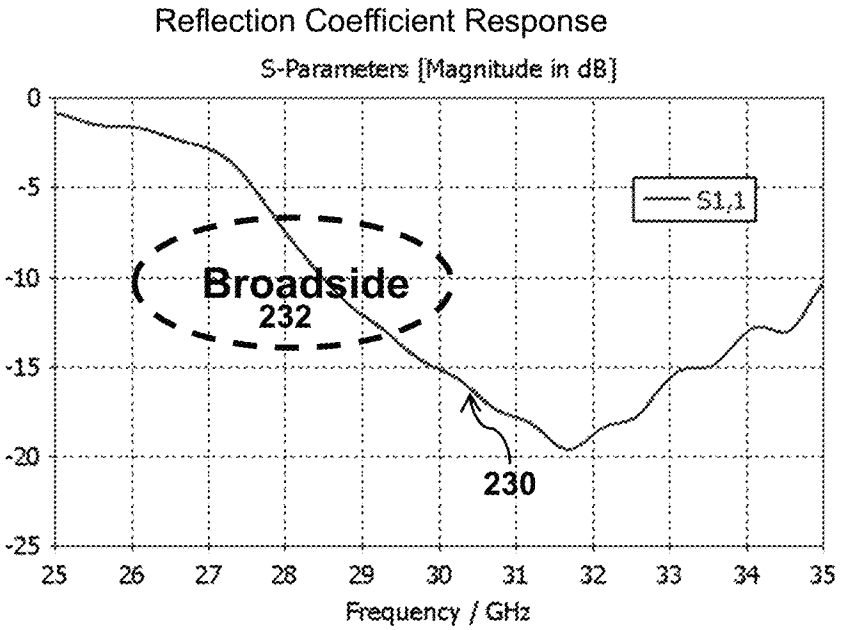
FIG. 2B illustrates a reflection coefficient response (in terms of the S11 parameter) upon excitation of leak-wave periodic slots from both side, in accordance with embodiments of the present invention. The location of the broadside frequencies is also shown.

By exciting the leaky-wave structure from both sides with 180 degree phase shift, part of the broadside radiation pattern happens outside the open stopband of the periodic structure in which the reflection coefficient seen from the ports are below −10 dB. Therefore, the LWA can be used for applications where broadside beam is required. The antenna reflection coefficient (S11 parameter) response 230 is illustrated in FIG. 2B. Notably, in FIG. 2B, the frequency range corresponding to part of the broadside operation 232 (about 26-30 GHz) is situated at least partially away from the open stopband.

Figure 3:
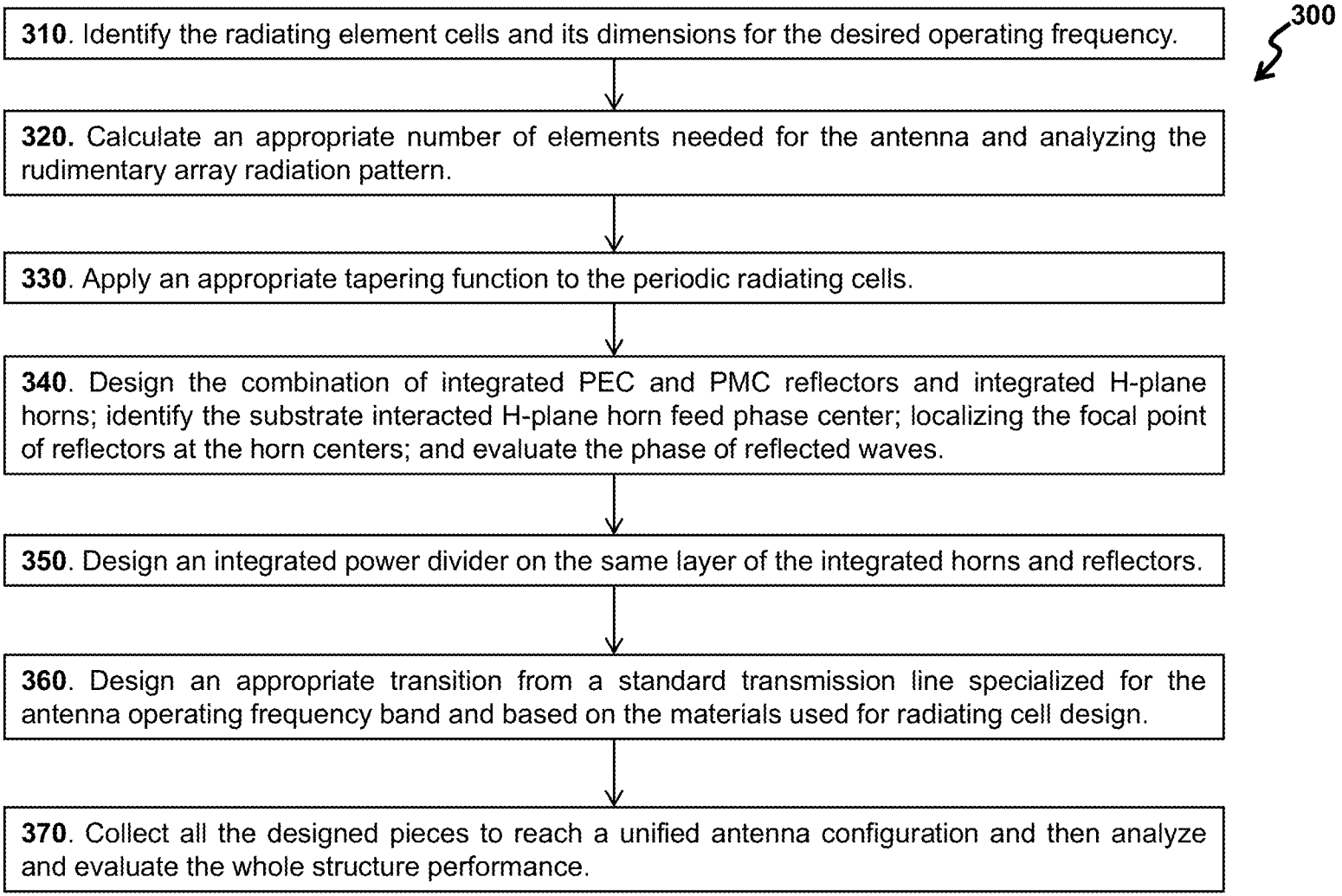
FIG. 3 illustrates a procedure for implementing the LWA design, in accordance with embodiments of the present invention.

FIG. 3 illustrates a procedure 300 for implementation of the LWA design, in accordance with embodiments of the present invention. At step 310, the radiating element (slot) cells of the LWA and dimensions of the (slot) cells may be identified for the desired operating frequency band. This may include a Bloch wave analysis to determine propagation and attenuation constants of the radiating element slot cells. At step 320, an appropriate number of elements needed for the LWA may be calculated and the rudimentary array radiation pattern may be analyzed by exciting the (slot) elements array from both sides of the leaky waveguide structure of the LWA via ideal wave ports. The ideal wave ports may be adjusted to provide a half-cycle phase shifted waves (e.g. 180 degrees phase shifted waves) for the (slot) array. At step 330, an appropriate tapering function may be applied to the periodic radiating (slot) cells to taper the attenuation constant in order to obtain the desired aperture distribution. Further details with respect to steps 310 to 330 will be provided below at the paragraphs for radiating structure design and analysis.

Step 340 may include designing the combination of integrated PEC and PMC reflectors and integrated H-plane horns as the offset feed of the reflectors. Step 340 may also include identifying the substrate integrated H-plane horn feed phase center and localizing the focal point of reflectors at the horn centers. Step 340 may further include evaluating the phase of reflected waves from the horn with minor adjustments of the horn position in front of the reflector to realize a location of the horn which provides a uniform phase front for the reflected waves. Step 350 may include designing an integrated power divider on the same layer of the integrated horns and reflectors to excite the feed horns simultaneously. Step 360 may include designing an appropriate transition from a standard transmission line, such as coaxial line (or microstrip, stripline, substrate integrated waveguide, etc.), specialized for the antenna operating frequency band and based on the materials used for radiating cell design. Further details with respect to steps 340 to 360 will be provided below at the paragraphs for excitation and feed design, including integrated reflectors designs and realizations, H-plane horn placements, substrate integrated waveguide (SIW) power divider design, and coax-to-SIW transition design and specifications.

At step 370, all designed pieces of the LWA may be collected to reach a unified antenna configuration. Step 370 may also include analyzing and evaluating the whole structure performance. Further details will be provided at the paragraphs for antenna results and discussions, including the antenna configuration with its simulated and measured results and descriptions.

Radiating Structure Design and Analysis

LWAs with different configurations have been widely studied over the years. In the periodic type of LWAs, the leaky mode is assumed to be excited by the periodic perturbation of a uniform structure that supports a slow bounded wave. Planar one-dimensional (1D) LWAs have a simple configuration which can produce a narrow conical fan-beam while scanning in backward and forward directions. The periodicity provides the possibility of a modal analysis along the longitudinal direction (called x here). By performing the modal analysis for an 1-D periodic structure, the longitudinal variation of modal fields could be expressed by the product of the fundamental traveling wave with complex propagation wavenumber, and a standing wave representing local variations arising from periodicity, which can be written in the following form as a superposition of space harmonics:

$$\overline{E}(x, y, z, t) = e^{-\alpha x} e^{-j\omega t} \sum_{n=-\infty}^{n=\infty} \overline{T_n}(y, z) e^{-j\beta_n x}$$

where $\beta_n = \beta_0 + 2\pi n/p$ is the phase constant of the nth space harmonic all with the same attenuation constant $\alpha$.

As mentioned, the behavior of periodic LWAs is particularly critical while scanning through the broadside. At the broadside point, the propagation constant of the radiating space harmonic $\beta_{-1}$ becomes zero which is corresponding to $\beta_0 p = 2\pi$. In this narrow frequency range, specified as open stopband (OSB), the radiated power drops significantly and appears as the reflection in the feeding ports because a perfect standing wave is set up within each unit cell and the attenuation constant of the radiating mode becomes very close to zero. This problem has not been fully explained and understood for many years but recently it has been a topic of considerable interest by proposing novel design approaches to suppress the open stopband gain drop of leaky-wave structures.

Figure 4:
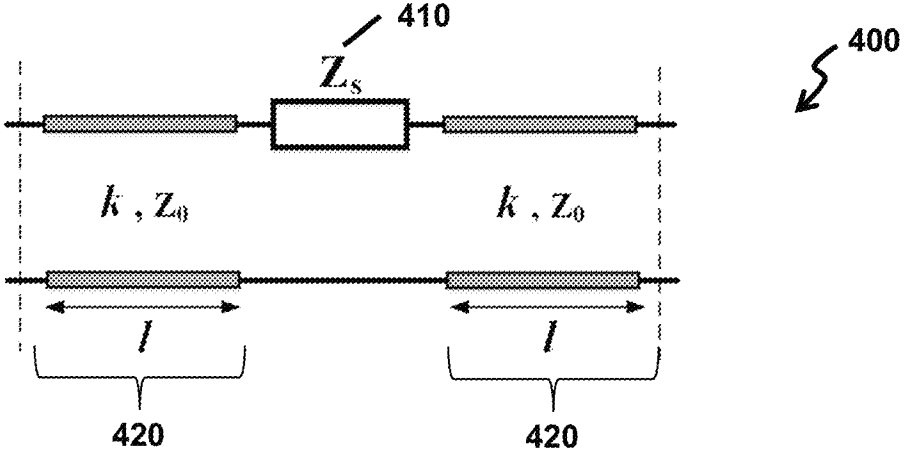
FIG. 4 illustrates an equivalent circuit model of a single slot module, in accordance with embodiments of the present invention.

According to embodiments, the one-dimensional (1-D) periodic array of slots on a grounded dielectric slab, which can produce scanning beam, is used for the radiating section of the LWA. Such periodic transverse slots can be modeled as an infinite unperturbed uniform transmission line, associated with the unperturbed propagation wavenumber in the absence of a material loss, periodically loaded with series impedances along the line. In other words, each unit cell of this structure consists of two equal lengths of transmission lines (l) with characteristic impedance $Z_0$ plus a series active impedance of the slot $Z_s$ across the middle of two transmission lines, as illustrated in FIG. 4. This active impedance represents the equivalent impedance of transverse slot radiating in the periodic environment which has a resistive part as well as a reactive part.

FIG. 4 illustrates an equivalent circuit model 400 of a single slot module, in accordance with embodiments of the present invention. According to embodiments, the voltage and current on either side of the single slot module illustrated in FIG. 4 can be related using the ABCD matrix as demonstrated below:

$$\begin{bmatrix} A & B \\ C & D \end{bmatrix} = \begin{bmatrix} \cos kl & jZ_0 \sin kl \\ jY_0 \sin kl & \cos kl \end{bmatrix} \begin{bmatrix} 1 & Z_s \\ 0 & 1 \end{bmatrix} \begin{bmatrix} \cos kl & jZ_0 \sin kl \\ jY_0 \sin kl & \cos kl \end{bmatrix}$$

Here, k is the propagation constant of the unperturbed dielectric filled transmission line for TEM propagation on either side of the single slot with equivalent series impedance $Z_s$ 410. With the Bloch wave analysis of a periodically loaded line by considering propagation in +x direction with propagation factor $e^{-2\gamma l}$, the dispersion characteristics of the periodic structure can be extracted. Based on the formulation for the infinite periodic structure, the propagation constant in terms of the transmission parameters of a single unit cell can be written as:

$$\cosh(\gamma p) = \frac{1}{2}(A + D) = \cos(2kl) + j\frac{Z_s}{Z_0}\sin(2kl)$$

$$\gamma = \alpha + j\beta = \frac{1}{p}\cosh^{-1}\left(\cos(2kl) + j\frac{Z_s}{Z_0}\sin(2kl)\right)$$

where β is the phase constant and a is the attenuation constant due to radiation of the propagating wave along the periodic structure, and p is the special period of the structure (p≈2l).

The model 400 includes two equal lengths of transmission lines 420 each with characteristic impedance $Z_0$ and a series impedance $Z_s$ interposed between the lengths of transmission lines.

The equivalent normalized impedance of the slot appeared above can also be determined by the transmission method, by measuring the transmission coefficient of the non-radiating (covered) slot module, $T_s$, and the transmission coefficient of the radiating slot module, T, with the following equation:

$$\frac{Z_s}{Z_0} = 2\left(\frac{T_s}{T} - 1\right)$$

At broadside frequency, all slots may be excited in phase and the fields between the adjacent slots may become a perfect standing wave instead of traveling wave. In this case, the voltage at each impedance may drop to zero. The zero voltage at each impedance may induce the absence of radiation. This may be a reason for loss of gain and high reflection coefficient at broadside frequencies.

Figure 5A:
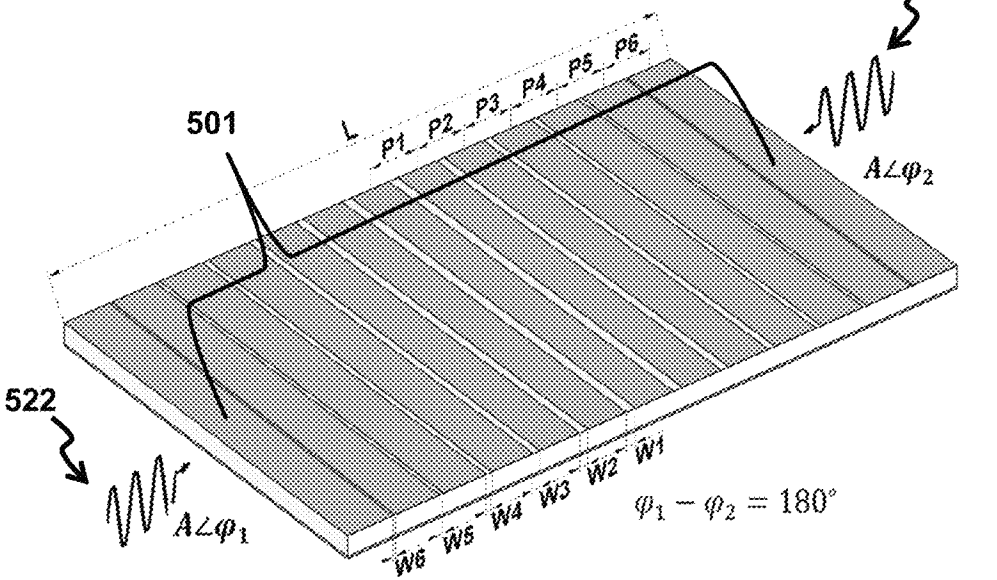
FIG. 5A illustrates geometry of a tapered transversally long slot array with excitation from both sides, in accordance with embodiments of the present invention.

According to embodiments, in order to achieve a broadside radiation with a finite array of the periodic slots outside its stopband, unlike the conventional designs, the array of the periodic slots may be fed from both sides with 180 degrees phase shift. The geometry of this array 501 is illustrated in FIG. 5A. The array 501 illustrated in FIG. 5A is a tapered transversally long slot array excited from both sides. In the illustrated embodiment, each of the periodic slots of the array 501 are placed perpendicular to a main axis extending between the first end and the second end of a leaky wave structure. Referring to FIG. 5A, in an example embodiment, $W_1$ may be 1.1 mm, $W_2$ may be 0.77 mm, $W_3$ may be 0.7 mm, $W_4$ may be 0.48 mm, $W_5$ may be 0.26 mm, and $W_6$ may be 0.16 mm. As such, the widths of the slots progressively increase toward the midpoint of the waveguide. The dimensions $P_1$=6.65 mm, $P_2$=6.58 mm, $P_3$=6.56 mm, $P_4$=6.52 mm, $P_5$=6.5 mm, and $P_6$=6.48 mm may be used to cause the propagation constants of the cells to coincide with each other. The excitations 522, 532 at both sides are shown, with these excitations being out of phase with each other by 180 degrees.

Figure 5C:
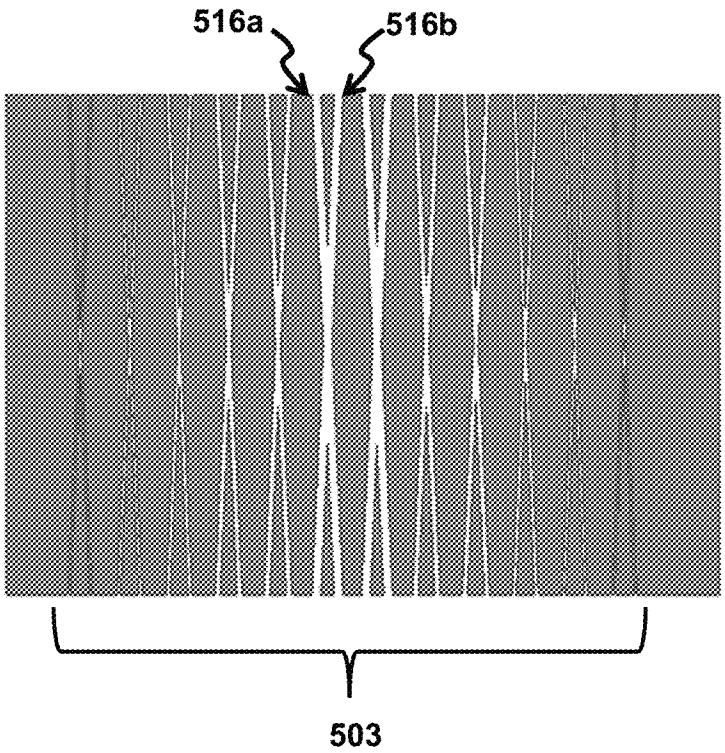
FIG. 5C illustrates geometry of a tapered crossed diagonally transverse long slot array with excitation from both sides, in accordance with embodiments of the present invention.
Figure 5B:
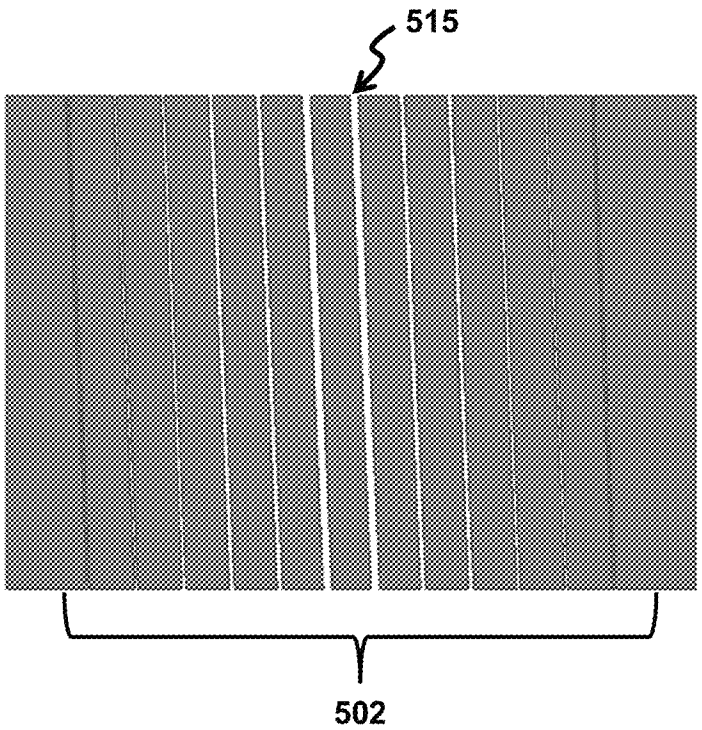
FIG. 5B illustrates geometry of a tapered diagonally transverse long slot array with excitation from both sides, in accordance with embodiments of the present invention.

According to embodiments, the geometry of the period slot array may be different from that of the period slot array 501 illustrated in FIG. 5A. In some embodiments, the period slot array may be a tapered diagonally transverse long slot array 502, as illustrated in FIG. 5B. Referring to FIG. 5B, each of the periodic slots (for example slot 515) of the array 502 are (slightly) tilted or slanted in one direction, compared to the periodic slot array 501 in FIG. 5A. In some other embodiments, the period slot array may be a tapered crossed diagonally transverse long slot array 503, as illustrated in FIG. 5C. Referring to FIG. 5C, each of the periodic slots (for example slots 516*a*, 516*b*) of the array 503 are tilted or slanted with some degree of angles; but in two directions, compared to FIG. 5B. A pair of slots may cross each other so that the two crossed-slots can form a x-crossed slot pair, as illustrated in FIG. 5C. Then, the x-crossed slot pairs will form the tapered crossed diagonally transverse long slot array 503 in FIG. 5C. As such, at least two of the slots are diagonally transverse in different directions and cross one another. For example, if a first slot forms an angle of +x degrees with the leaky wave structure main axis, a second slot, crossing the first slot, may form an angle of −x degrees with the main axis. For example, slots 516*a* and 516*b* form an x-crossed slot pair.

According to embodiments, each of the tapered diagonally transverse long slot array 502 in FIG. 5B and the tapered crossed diagonally transverse long slot array 503 in FIG. 5C may be excited from both sides in a similar way in which the periodic slot array 501 in FIG. 5A is excited.

Figure 5D:
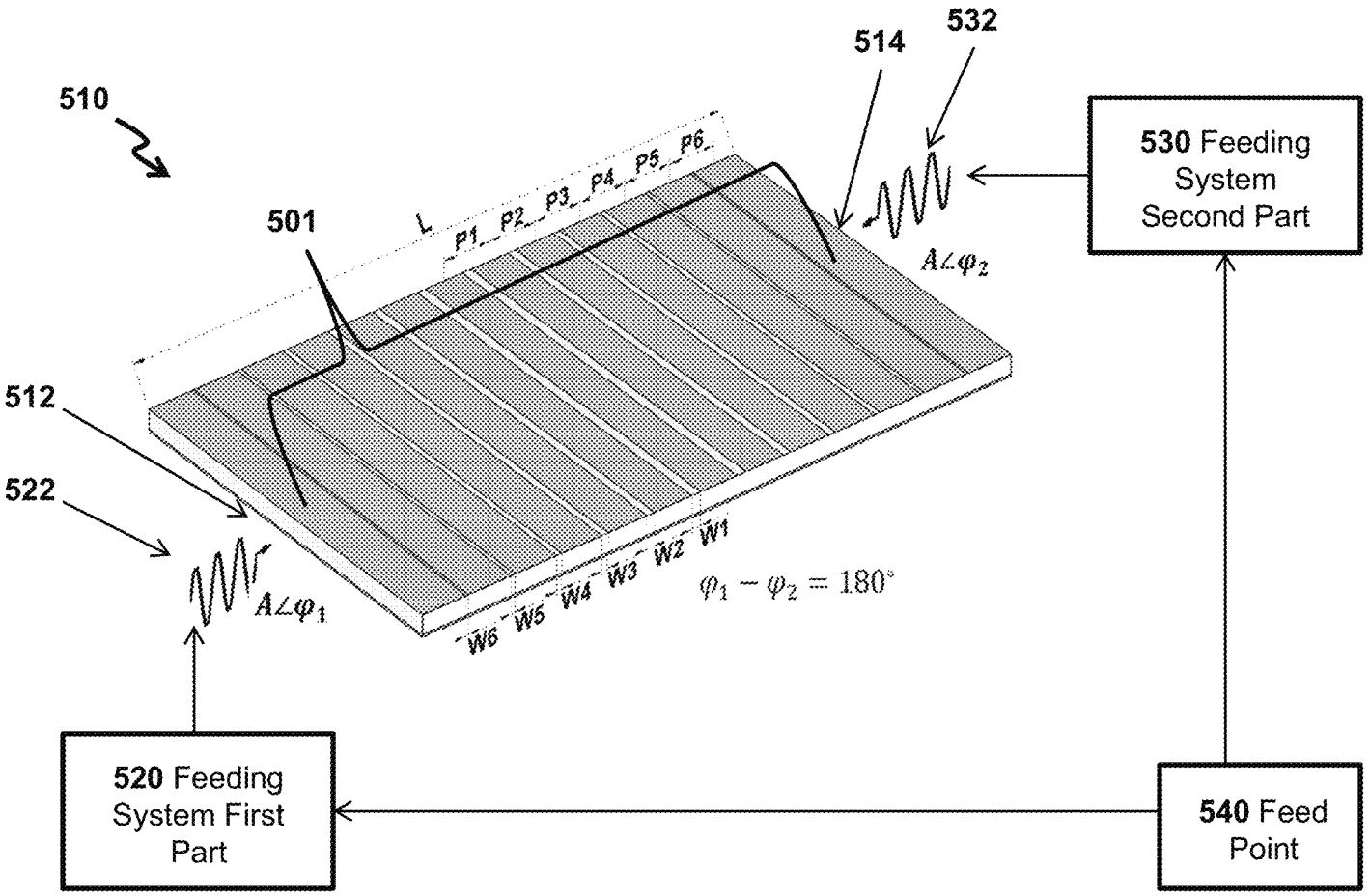
FIG. 5D schematically illustrates an antenna comprising the slot array of FIG. 5A, in accordance with embodiments of the present invention.

FIG. 5D schematically illustrates an antenna comprising a leaky wave structure 510 such as the slot array 501 illustrated in FIG. 5A. The leaky wave structure includes a first end 512 and a second end 514. The antenna further includes a feeding system having a first part 520 and a second part 530. The first part 520 is configured to direct a first signal 522 to or from the first end 512 of the leaky wave structure. The second part 530 is configured to direct a second signal 532 to or from the second end 514 of the leaky wave structure, the second signal being an anti-phase version of the first signal. The first part 520 and the second part 530 of the feeding system can be coupled to a common feed point 540 of the antenna.

Being excited from both sides, the structure (e.g. of the long slot array or other embodiments) provides two scanning beams in the forward and backward directions. The scanning beams approach each other towards the middle of the array. Since the excited waves are out of phase and propagating in opposite directions, two beams are added together in the middle of the array while they approach the broadside. Therefore, a single broadside beam can be obtained outside the stopband of the periodic structure because the beams start being added together few degrees before the broadside and before entering the stopband region.

For a uniform periodic leaky wave structure, the antenna length (L) may be chosen to have most of the power radiated with a constant leakage factor (α) along the antenna, which is a measure of the power leaked per unit length. To have 90 percent of the power radiated along the uniform antenna structure, the following approximate relation was proposed between the antenna length and the leakage factor:

$$\frac{L}{\lambda_0} \approx \frac{0.18}{\alpha/k_0}$$

where $k_0$ is the free-space wavenumber and $\lambda_0$ is the wavelength. In order to have an approximation of the optimum antenna length, this relation is used in scanning frequencies before approaching near broadside frequencies where a has almost linear behavior.

In a completely uniform leaky waveguide, propagation and attenuation constants are substantially invariant along the antenna length and the aperture distribution has an exponential amplitude variation and a constant phase which results in a high sidelobe level. Since the aperture illumination determines the sidelobe level, the leakage rate may be varied along the antenna longitudinal direction in a specific fashion to control leakage power along the antenna to reach the desired illumination function.

For the single-fed leaky-wave antenna, the relation between the power distribution along the antenna and the varying attenuation constant $\alpha$ (z), by considering $P_0$ as input power in the feeding point, can be written as following.

$$(x) = P_0 \exp\left[-2\int_0^x \alpha(\zeta)d\zeta\right].$$

The transverse dimension of the leaky-wave structure governs the rate of attenuation $\alpha$. For a particular type of leaky-wave structure, the connection between the attenuation ratio and transverse dimensions can be determined theoretically and/or experimentally. As the periodic leaky structure utilized in this design may be fed from both sides and the radiated power may be concentrated in the middle of the antenna, it would be useful to divide the structure into two identical leaky wave antennas with the maximum leakage at the end of each section. For a specific aperture distribution and by considering $e_r$ as the radiation efficiency, which is defined as the power radiated into free space from each half divided by the total power given to each half, a relation between varying attenuation constant and controlled distribution of the aperture can be obtained as following:

$$\left(0 < x < \frac{L}{2}\right)$$

$$\alpha(x) = \frac{0.5e_r|A(x)|^2}{\int_0^{L/2}|A(\zeta)|^2 d\zeta - e_r\int_0^Z |A(\zeta)|^2 d\zeta}$$

where A(x) is the desired aperture distribution in the first half of the periodic radiating section. As there is no match load, the remaining power in each section would flow to the opposite side. Accordingly, the aperture field distribution in the first section can be written as follows:

$$A(x)=K(x)e^{j\omega t}[e^{-j\beta_0 x}+(1-e_r)e^{j(\beta_0 x+\pi)}].$$

According to embodiments of the present invention, in order to reach an optimized sidelobe level, a Taylor distribution may be applied to obtain a specified aperture illumination. To realize a varying attenuation constant along the leaky structure with this distribution, non-uniform slot modules are used to control the leakage ratio along the antenna. In other words, the width of each slot cell is modified based on the tapering coefficients to achieve a unique attenuation ration for each cell which could result in the desired aperture illumination. Here, the substrate material of RO6002 with the dielectric constant of 2.94 and thickness of 1.52 mm is used as the main antenna layer including the radiating slot array.

Figure 6:
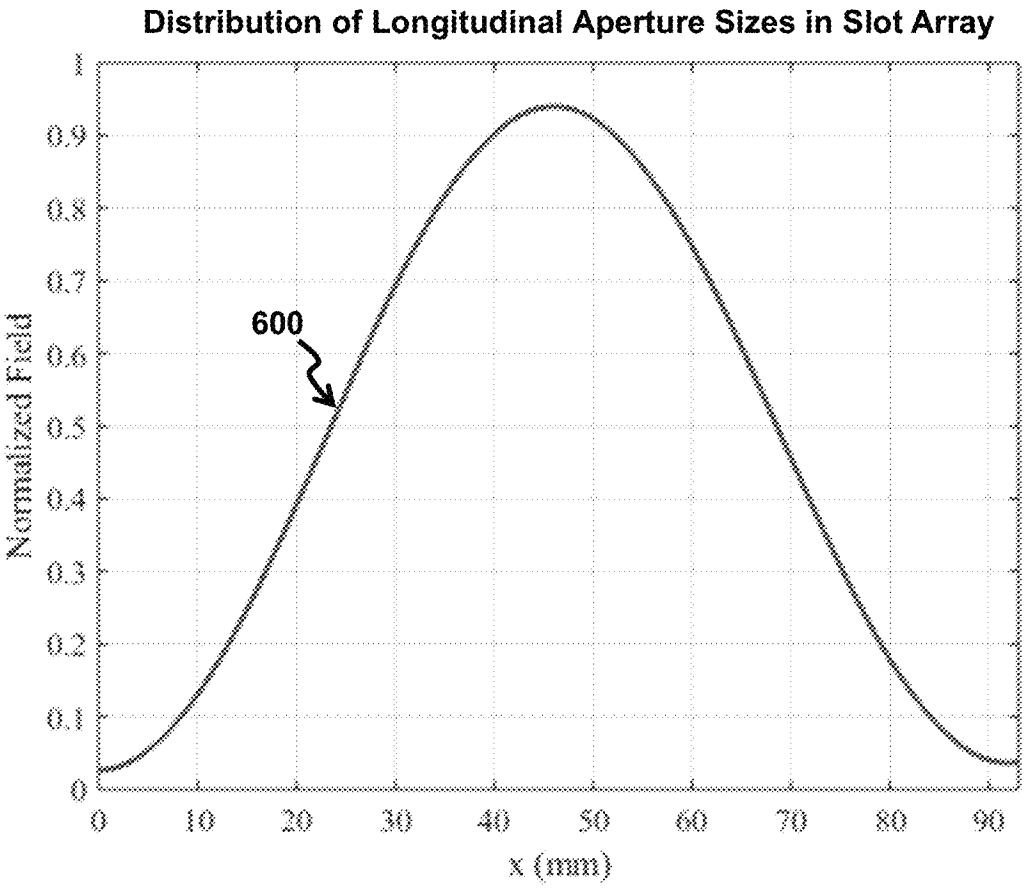
FIG. 6 illustrates an approximated desired longitudinal aperture distribution, in accordance with embodiments of the present invention.

FIG. 6 illustrates an approximated desired longitudinal aperture distribution, in accordance with embodiments of the present invention. According to embodiments, the distribution 600 of aperture is approximated based on the desired radiation pattern and the corresponding attenuation constant variation along the longitudinal direction can be achieved with the following equation:

$$A(x)=0.5\sin(7.4x+1.2)+0.44\sin(69x-1.6).$$

Figure 7A:
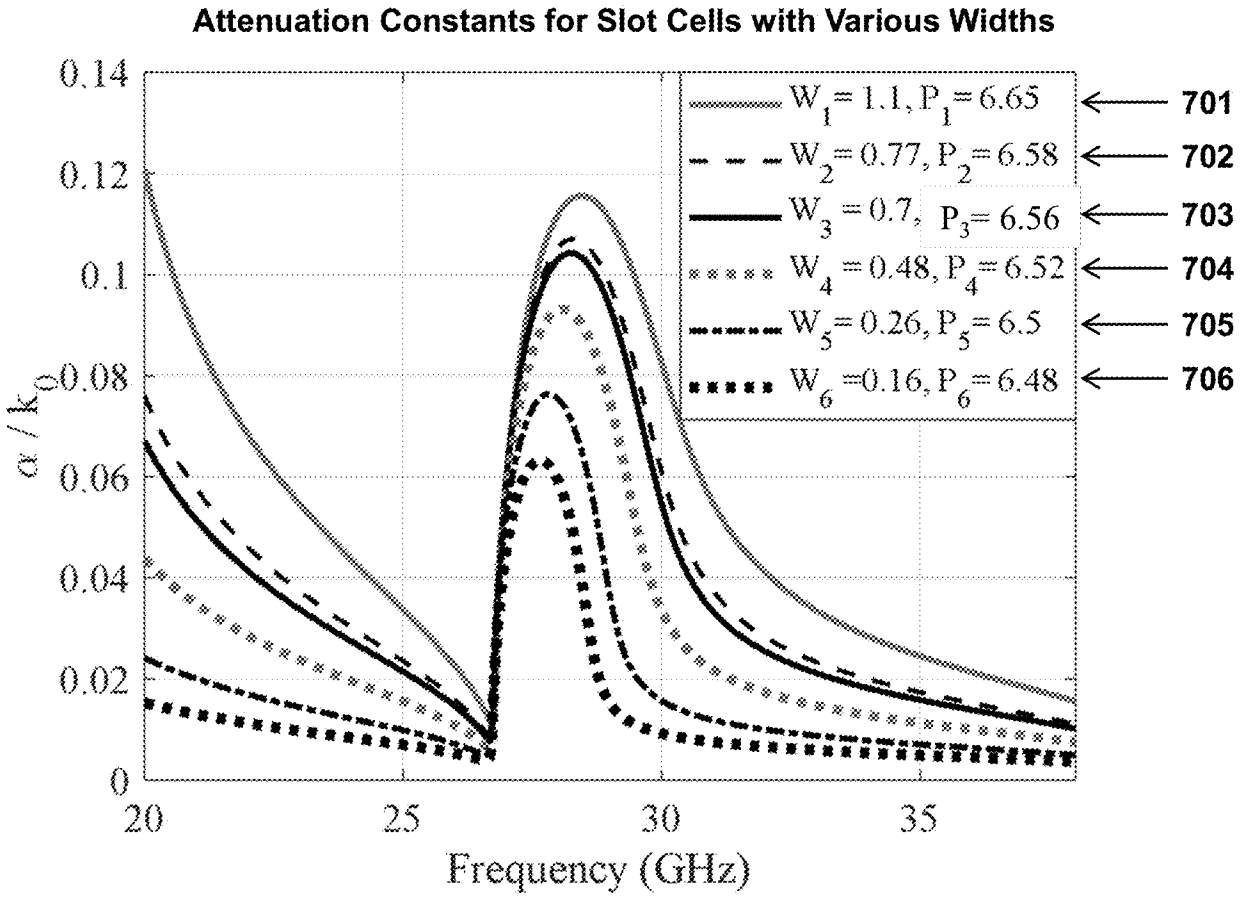
FIGS. 7A and 7B illustrate normalized attenuation constant and phase constant, respectively, for slot cells with different width, in accordance with embodiments of the present invention.
Figure 7B:
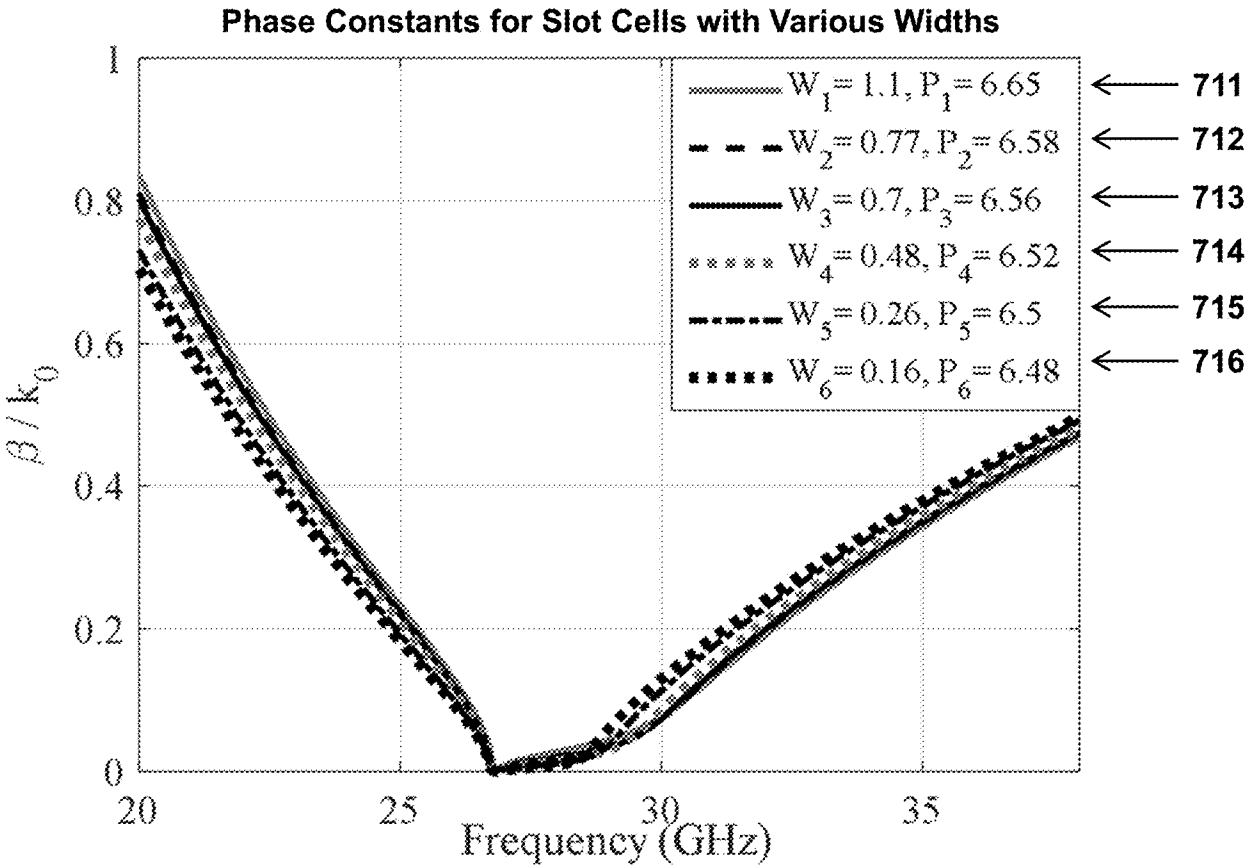

FIGS. 7A and 7B illustrate normalized attenuation constant and phase constant, respectively, for slot cells with different width, in accordance with embodiments of the present invention. FIGS. 7A and 7B illustrate the attenuation constant $\alpha$ and the phase constant $\beta$ when the width of the slot cell is $W_6$=0.16 mm, $W_5$=0.26 mm, $W_4$=0.48 mm, $W_3$=0.7 mm, $W_2$=0.77 mm, and $W_1$=1.1 mm. Corresponding dimensions for $P_1$ to $P_6$, in mm, are also given (i.e. $P_1$=6.65 mm, $P_2$=6.58 mm, $P_3$=6.56 mm, $P_4$=6.52 mm, $P_5$=6.5 mm, and $P_6$=6.48 mm). The absolute values of the normalized attenuation constant $\alpha$ and phase constant $\beta$ of the slot cells in FIGS. 7A and 7B are extracted, using the Bloch wave analysis, for different width of slots. In the first step, the total cell dimensions are kept constant and only the width of the slot is changed based on the tapering coefficients. In some embodiments, tapering is also applied in the transverse direction, e.g. in the direction of the slots. For example, a slot's width can be varied along its length. This may allow control over the side lobe levels in the antenna H-plane. In some embodiments, the tapering function may be varied based on the slot arrangements of transverse slots, diagonally transverse slots, or crossed diagonally transverse slots. Changing the width of the slot may cause some minor deviations in the phase constant $\beta$ of the slot cells, compared to the phase constant $\beta$ of the uniform structure. In fact, while changing the local cross-sectional geometry of a guiding structure to modify the value of the attenuation constant $\alpha$ at some point, the value of the phase constant $\beta$ is also modified slightly at that point. However, for the leaky wave structure, the value of the phase constant $\beta$ must remain constant alongside the aperture to have the radiation from all parts of the aperture point in the same direction. Accordingly, the dimension of each radiating cell is modified to keep the value of $\beta$ being constant for all cells, as seen in FIG. 5A. In order to keep beta curves to be similar to each other, periodicity of the single cells may be modified by changing width of the slots.

More specifically, FIG. 7A illustrates normalized attenuation constant 706 corresponding to slot cell width $W_6$=0.16 mm, normalized attenuation constant 705 corresponding to slot cell width $W_5$=0.26 mm, normalized attenuation constant 704 corresponding to slot cell width $W_4$=0.48 mm, normalized attenuation constant 703 corresponding to slot cell width $W_3$=0.7 mm, normalized attenuation constant 702 corresponding to slot cell width $W_2$=0.77 mm, and normalized attenuation constant 701 corresponding to slot cell width $W_1$=1.1 mm. FIG. 7B illustrates normalized phase constant 716 corresponding to slot cell width $W_6$=0.16 mm, normalized phase constant 715 corresponding to slot cell width $W_5$=0.26 mm, normalized phase constant 714 corresponding to slot cell width $W_4$=0.48 mm, normalized phase constant 713 corresponding to slot cell width $W_3$=0.7 mm, normalized phase constant 712 corresponding to slot cell width $W_2$=0.77 mm, and normalized phase constant 711 corresponding to slot cell width $W_1$=1.1 mm.

Excitation and Feed Design

As stated above, in order to obtain a broad radiation from a slot array outside its stopband, the slot array can be excited from both sides with two excitation signals relatively phase shifted by a half cycle (i.e. in anti-phase). This excitation may be done with the ideal wave ports of the simulator to produce the parallel plate plane waves. The ideal wave ports are also adjusted to have 180 degrees phase shift at the center frequency. However, to realize a simultaneous excitation of the structure with the phase shifted plane waves, a special feeding system may be required. Example feeding systems are described below. In one embodiment, the feeding system includes a first part having a PEC reflector and a second part having a PMC reflector, thereby achieving the half cycle relative phase shift. In another embodiment, the feeding system includes two parts which have substantially identical reflectors (e.g. PEC reflectors), but with the path lengths of the two parts differing by a half of an operating wavelength.

The plane wave between the parallel plates can be generated using a plate dielectric lens or a parabolic cylindrical reflector. The plate dielectric lens and/or the parabolic cylindrical reflector are required to have a point source at the focal point since they are designed based on geometrical optics approach. As such, in some embodiments of the present invention, a couple of integrated off-set reflectors may be used to excite the periodic slots. Because the point source cannot be ideally realized, an H-plane sectoral horn may be substituted for the source. Therefore, the phase center of the H-plane sectoral horn may be determined in order to place the geometric optical focus of the reflector at the given position. In some embodiments, the phase center of the H-plane sectoral horn may be defined as a theoretical point along the axis of the horn, at the center of an observation circle where the sum of absolute values of the phase differences at the observation angle is minimized. In some other embodiments, the phase center can be more generally defined at a point where the reflector gain is maximized.

The length of the H-plane sectoral horn, which is integrated into the same substrate of the periodic slots, may be kept as short as possible with optimum flare angle having non-destroyed phase pattern in its aperture. The phase center of this H-plane sectoral horn may be extracted with a full wave analysis while being integrated into a dielectric filled parallel plate. After posing the focal point of the reflector in the determined phase center of the horn, in order to completely coincide with the horn phase center, the horn position is shifted slightly on its axis and the phase of the reflected wave from the reflector is monitored to reach the best uniform phase front.

The identical integrated reflectors are used for reflecting parallel plate plane waves to excite the periodic slots from lateral sides. Therefore, the same sectoral integrated H-plane horn is used as an offset feed for both reflectors. The offset feeding mechanism of the integrated reflector enables the feeding horns to be integrated in the same layer of the reflector without providing any blockage to the reflected waves. FIG. 8A illustrates a complete geometry of a proposed LWA with the integrated PEC reflectors and horns including the long radiating slots with the tapered widths, in accordance with embodiments of the present invention. The illustrated geometry shows a patterned conductive top layer of a planar lithographic layer structure, which, together with a dielectric middle layer and conductive bottom layer (which may be patterned or substantially unpatterned), form the antenna.

Referring to FIG. 8A, the LWA 800 includes a leaky wave structure 870 having a first end 872 and a second end 874, and an array of slots 876 which are transverse to a main axis extending between the first end and the second end. The LWA further includes a feeding system including a first part and a second part. The first part includes a first PEC reflector 810, an H-plane horn 830, and a first half 852 of a power divider 850. The second part includes a second PEC reflector 820, an H-plane horn 840, and a second half 854 of the power divider 850. The first PEC reflector 810 directs a first signal to the first end 872 of the leaky wave structure, while the second PEC reflector 820 directs a second signal to the second end 874 of the leaky wave structure. The LWA 800 further includes a feed point, in the present case formed as a coax-to-SIW transition 860.

The H-plane horns 830 and 840 are tilted about 60 degrees around their phase centers in order to direct waves towards the middle of the reflectors 810, 820. The lower arms of the H-plane horns 830 and 840 are extended to form boundaries 831 and 841, for example provided as via fences or square or rectangular slots with metallized faces formed in conductive sheet. The lower arms of the H-plane horns 830 and 840 are extended to the PEC reflectors 810 and 820 in order to prevent any spurious parallel plate propagation outside the reflector boundaries.

Figure 8B:
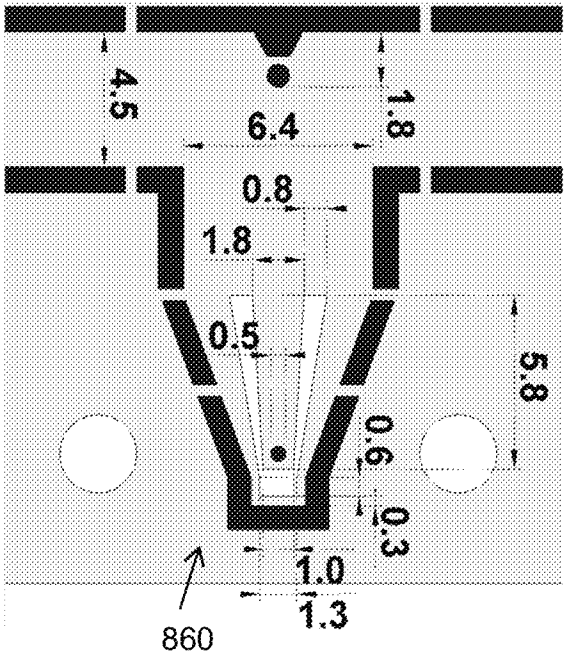
FIG. 8B illustrates the coax-to-SIW transition of the LWA of FIG. 8A, with dimensions, in accordance with an embodiment of the present invention.

To produce the 180 degrees phase shift (e.g. half-cycle phase shift) between the reflected waves reaching the periodic slots from both sides, the whole array of slots is shifted toward one of the reflectors (e.g. reflector 810 or 820) by a quarter of an operating wavelength corresponding to the center frequency of antenna operation. This results in a quarter-wavelength decrease in distance on one side of the slot array and a quarter-wavelength increase in distance on the other side, thereby achieving a half-wavelength difference in distances which would be equal before the shift. As such, the first distance $d_1$ between the reflector 810 and first end 872 of the leaky wave structure, and the second distance $d_2$ between the reflector 820 and second end 874 of the leaky wave structure are set such that $d_2-d_1=\lambda_g/2$. Therefore, the oppositely directed waves with a half-cycle phase shift constructively contribute to providing the LWA 800 with directive broadside beam. Alternatively this can be achieved by setting $d_2-d_1=n\lambda_g+\Delta_g/2$, where n is a whole number. The feeding horns 830 and 840 are connected to an SIW power divider 850 with the identical arms for the simultaneous excitation of the reflectors 810 and 820. A specialized coax-to-SIW transition 860 is designed at the antenna frequency band based on the utilized substrate, and connected to the SIW power divider 850 to feed the antenna. An example geometry of the coax-to-SIW transition 860 is further illustrated in FIG. 8B with all dimensions in millimeters. It is noted that the ends 872 and 874 of the leaky wave structure may be relative to the positions of the slots 876. Therefore, configuring the positions of the first and second ends, hence configuring the distances $d_1$ and $d_2$ may be performed by configuring the positions of the slots.

According to embodiments, all integrated metallic walls of the reflectors 810 and 820, the H-plane horns 830 and 840, the power divider 850, and the coax-to-SIW transition 860 are realized by the plated slots (e.g. plated rectangular cubes passing through the layered structure) instead of metallic posts because the plated slots are simple to fabricate and closely resemble to the conventional rectangular waveguides. The spacing between the plated slots may be considered to meet the standard SIW design criteria for minimization of the leakage among the slots. The antenna may be excited with coaxial air-interface K (2.92 mm) connector with double fixing screws, which operates free from high-order modes up to 40 GHz. It should be noted that the antenna can be dimensioned for other frequency ranges.

FIG. 9 illustrates the geometry of another LWA with the integrated PEC and PMC reflectors, in accordance with embodiments of the present invention. The geometry is similar to the antenna of FIGS. 8A and 8B, except that one of the PEC reflectors is replaced with a PMC reflector 920. In other words, instead of two PEC reflectors, one PEC reflector 810 and one PMC reflector 920 are integrated into the LWA 900. Since the reflected waves from PEC and PMC surfaces inherently have differ by 180 degrees, the anti-phase condition for the first and second signals is achieved by using the two different types of reflectors. Thus, for the LWA 900, there is no need to use different spacings $d_1$ and $d_2$ in order to produce the anti-phase condition. As such, the first distance $d_1$ between the PEC reflector 810 and first end 872 of the leaky wave structure may be set equal to the second distance $d_2$ between the PMC reflector 920 and second end 874 of the leaky wave structure (e.g. $d_1=d_2$). Alternatively, $d_1=d_2+n\lambda_g$ may be used.

Referring to FIG. 9, the LWA 900 includes the PEC reflector 810, the PMC reflector 920, the H-plane horns 830 and 840, the power divider 850, the coax-to-SIW transition 860, and the leaky waveguide structure 870 comprising an array of (long) slots 876. The integrated PMC reflector 920 may be realized by a fine cutting of the substrate corner based on cylindrical parabolic reflector equation, leaving a void 922 free of conductive material behind the PMC reflector 920. The phase center of the feeding H-plane horn 840 is located at the focal point of the PMC reflector 920.

The boundary, between conductive sheet and void 922, defining the PMC reflector 920 may be formed by cutting an edge of a double grounded substrate operating as the PMC reflector boundary. This boundary can be intensified by using a high dielectric constant laminate and also by decreasing the layer thickness. According to embodiments, the boundary at 920 is not an ideal shielded PMC boundary, and some minor leakages or fringing field is expected from the PMC reflector 920. All design parameters and other details of the LWA 900 may be kept the same as those of the LWA 800; but with the right reflector being a PMC reflector 920 and the slot array being equidistant from both reflectors.

According to embodiments of both types of LWAs (e.g. LWA with two integrated PEC reflectors and LWA with integrated PEC and PMC reflectors), bounding walls are implemented with plated slots in the lower region of the slot array till upper arms of the feeding horns to confine the reflected waves from the reflectors in the middle of the array.

The two types of LWAs are made for the antenna demonstration with PEC-PEC and PEC-PMC reflectors and the same substrate material. The antennas may be connected to double screw 2.92 mm K connectors which are exciting them by a modified coax-to-SIW transition.

Figure 10:
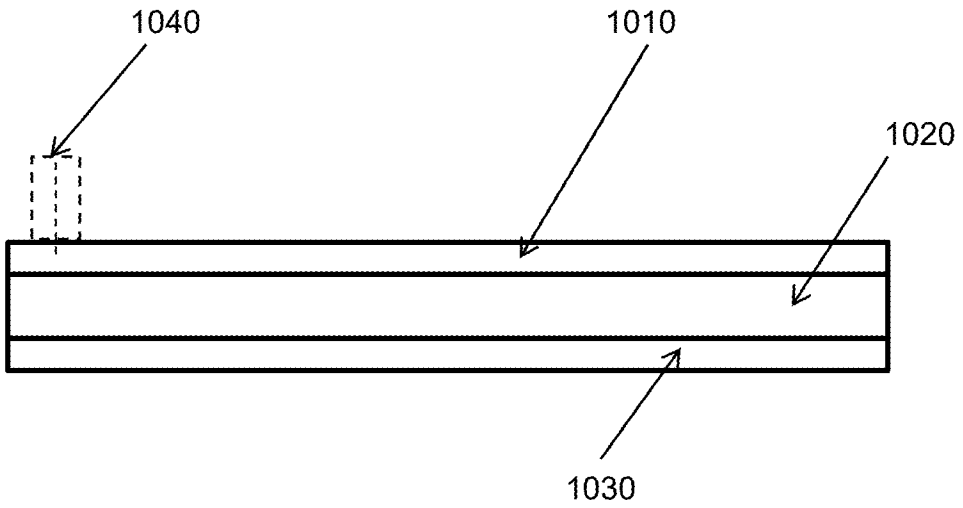
FIG. 10 illustrates a side view of a LWA, in accordance with embodiments of the present invention.

FIG. 10 schematically illustrates a side view of a LWA, such as the LWA shown in FIGS. 8A and 9, according to embodiments of the present invention. The LWA is formed from an upper conductive layer 1010, a lower conductive layer 1030, and a dielectric layer 1020 sandwiched between the upper conductive layer 1010 and the lower conductive layer 1030. At least the upper conductive layer 1010 may be patterned to define parts of the antenna, such as shown in FIGS. 8A and 9. Thus, the leaky wave structure, the first part, and the second part, are all formed in a single, common planar portion of a lithographic layer structure. As such, the antenna design is simplified. An example transmission line 1040 coupled to an antenna feed is also shown. It will be understood that in the embodiments illustrated in FIGS. 8-10, the feed may be located at opposing sides of the radiating structure so that the antenna can be fed from both sides. In other embodiments a single feed point may be used. Feeding from more than one feed point (but not at opposite ends) can also be implemented.

Antenna Results and Discussions

Figure 11A:
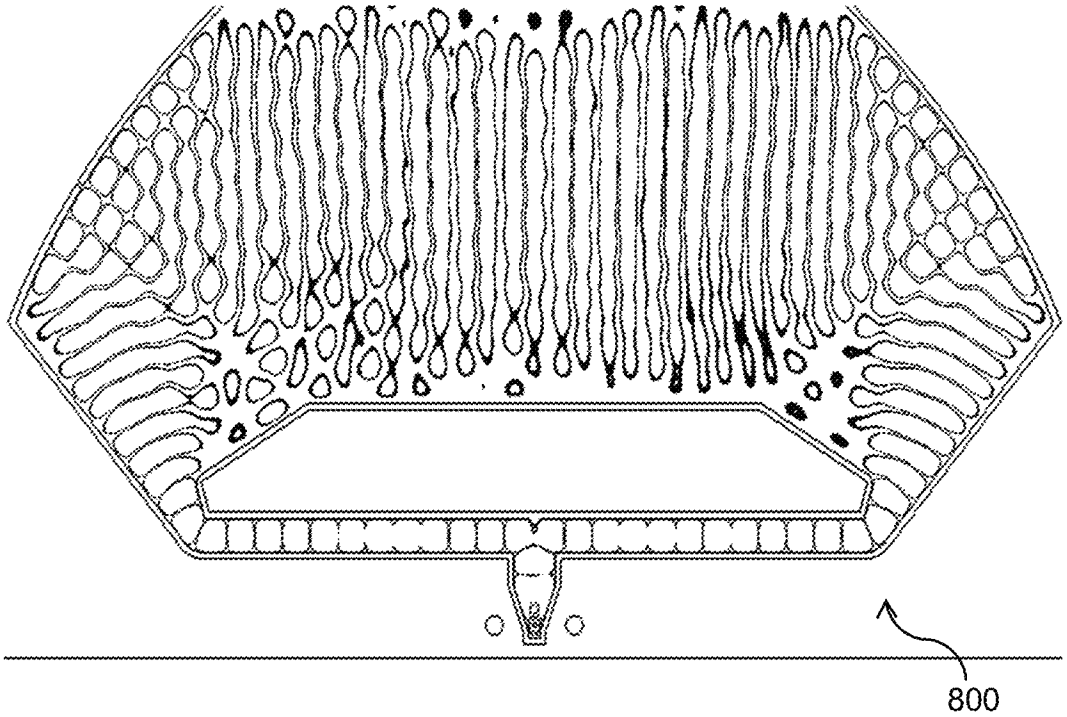
FIG. 11A illustrates the amplitude of the electric field distribution inside the antenna of FIG. 8A, at the center frequency of 28 GHz, in accordance with embodiments of the present invention.
Figure 11B:
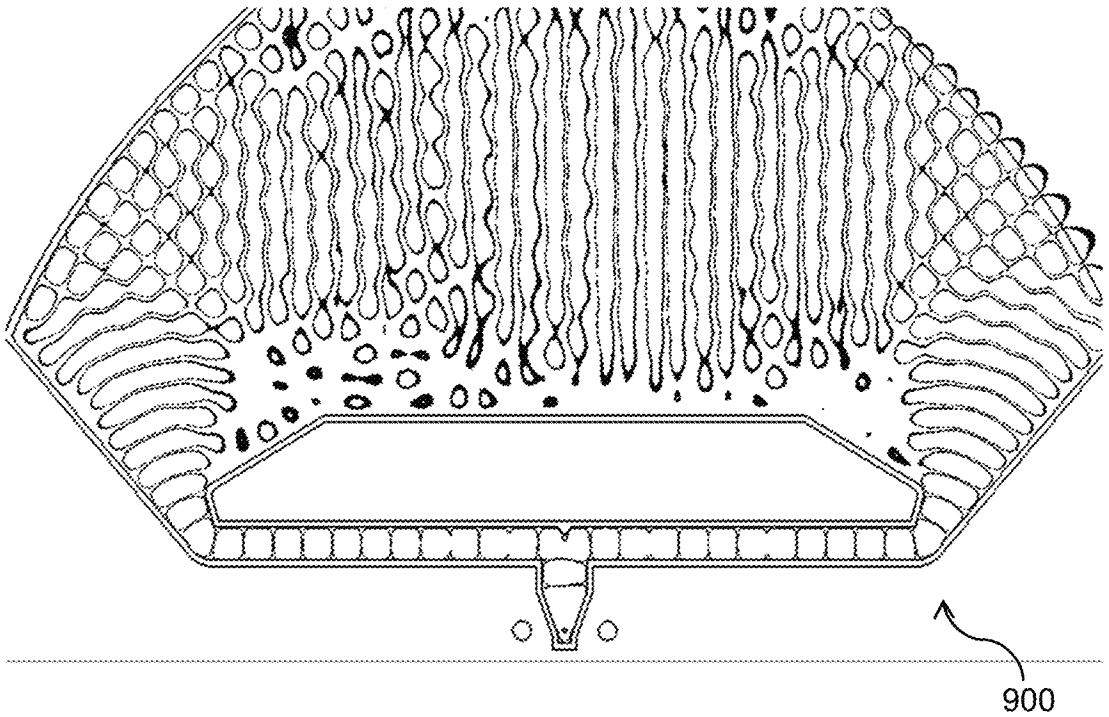
FIG. 11B illustrates the amplitude of the electric field distribution inside the antenna of FIG. 9, at the center frequency of 28 GHz, in accordance with embodiments of the present invention.

The following results are presented by way of illustrative example, and are not intended to be limiting to the invention. FIGS. 11A and 11B illustrate the amplitude of the electric field distribution inside the antennas 800, 900 at the center frequency of 28 GHz with PEC-PEC reflectors and PEC-PMC reflectors, respectively, in accordance with embodiments of the present invention as illustrated in FIGS. 8A and 9. As illustrated in FIGS. 11A and 11B, the reflected fields from the reflectors are in the planar form and traveling toward each other to excite the slot array. The slots are extended outside the reflectors region from the upper side to have continuous radiating slots in front of the reflected waves.

Figure 12:
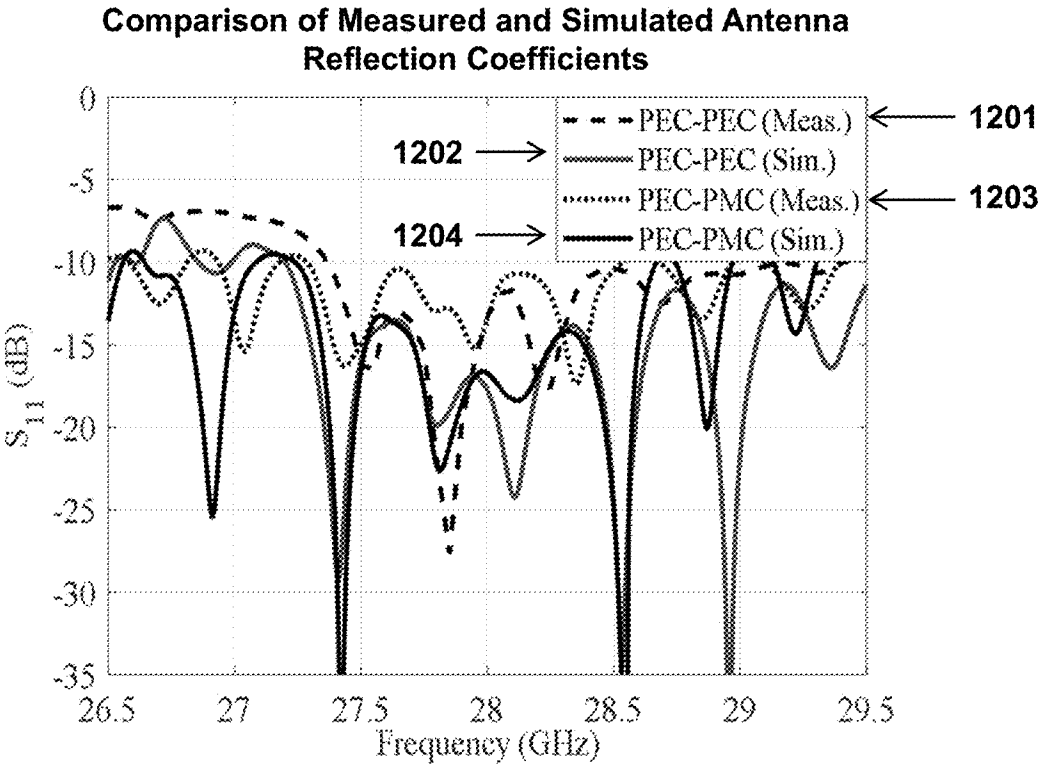
FIG. 12 illustrates measured and simulated reflection coefficients of the antennas of FIGS. 8A and 9, in accordance with embodiments of the present invention.

FIG. 12 illustrates measured and simulated reflection coefficients of the proposed antennas with PEC-PEC and PEC-PMC reflectors, in accordance with embodiments of the present invention as illustrated in FIGS. 8A and 9. The reflection coefficient of the antennas in a 28 GHz band (suitable for 5G communications and which is specified as being between 27.5 GHz and 28.35 GHz) is below −10 dB in both simulation and measurement plots. At the broadside frequency of the periodic LWA that is around 27 GHz, which can be extracted from the plots in FIGS. 7A and 7B, there is a high standing wave inside the antenna. However, after the theoretical broadside frequency, the antenna starts radiating with the few degrees of tilted beams. In various embodiments of LWA with the designs proposed above, the tilted beams are added together and result in a broadside beam after the broadside frequency of the periodic structure. In more detail, FIG. 12 illustrates measured reflection coefficient 1201 for antenna with PEC-PEC reflectors, simulated reflection coefficient 1202 for antenna with PEC-PEC reflectors, measured reflection coefficient 1203 for antenna with PEC-PMC reflectors, and simulated reflection coefficient 1204 for antenna with PEC-PMC reflectors.

Figure 13A:
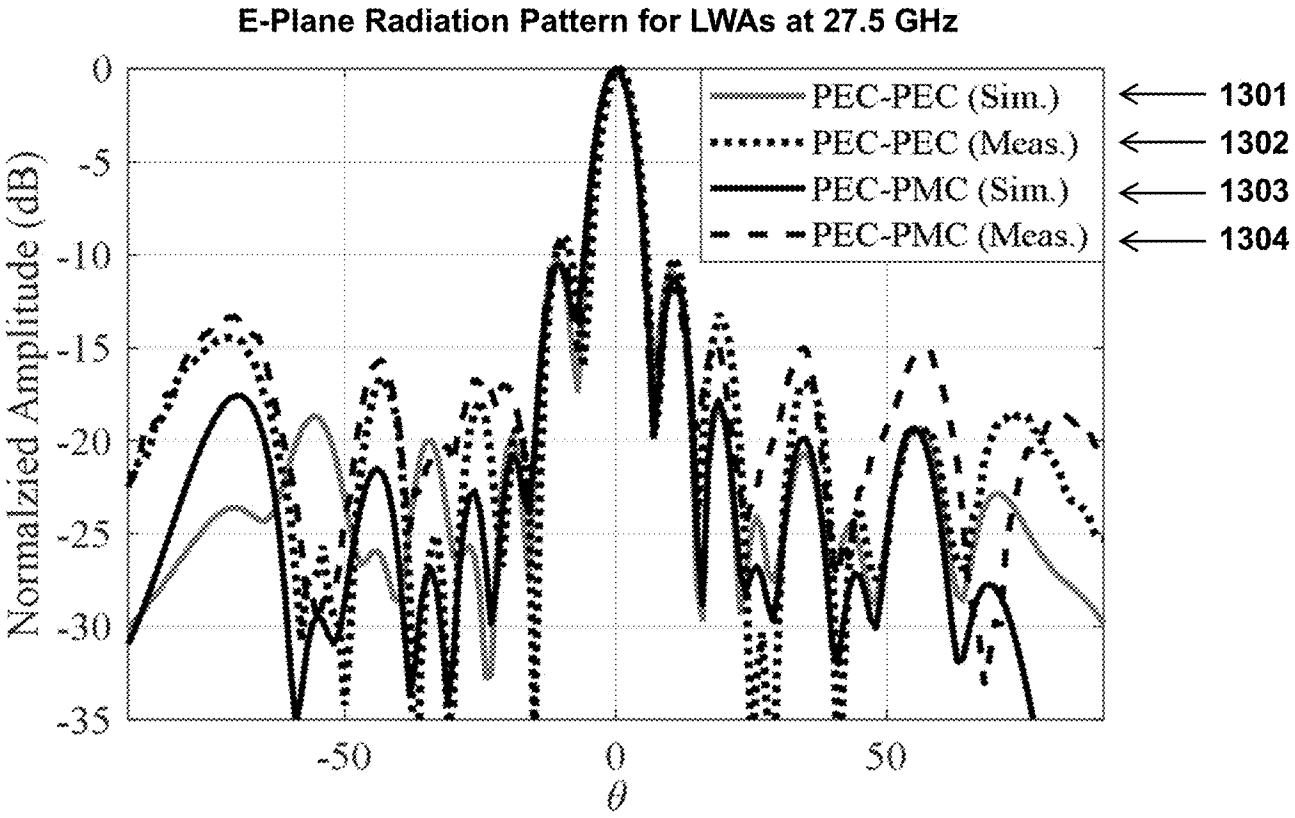
FIGS. 13A to 13F illustrate normalized simulated and measured radiation patterns of the antennas of FIGS. 8A and 9, at three different frequencies, in accordance with embodiments of the present invention.
Figure 13B:
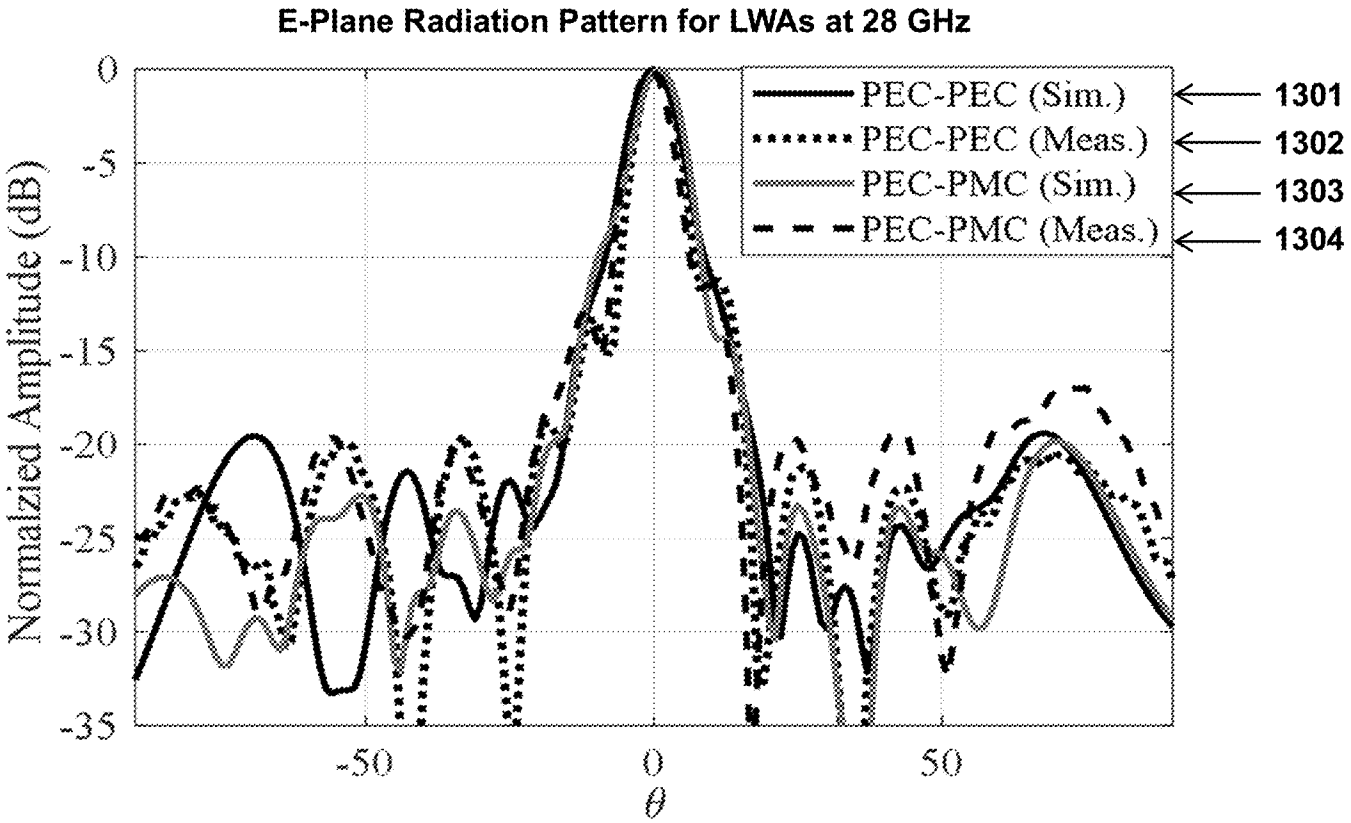
Figure 13C:
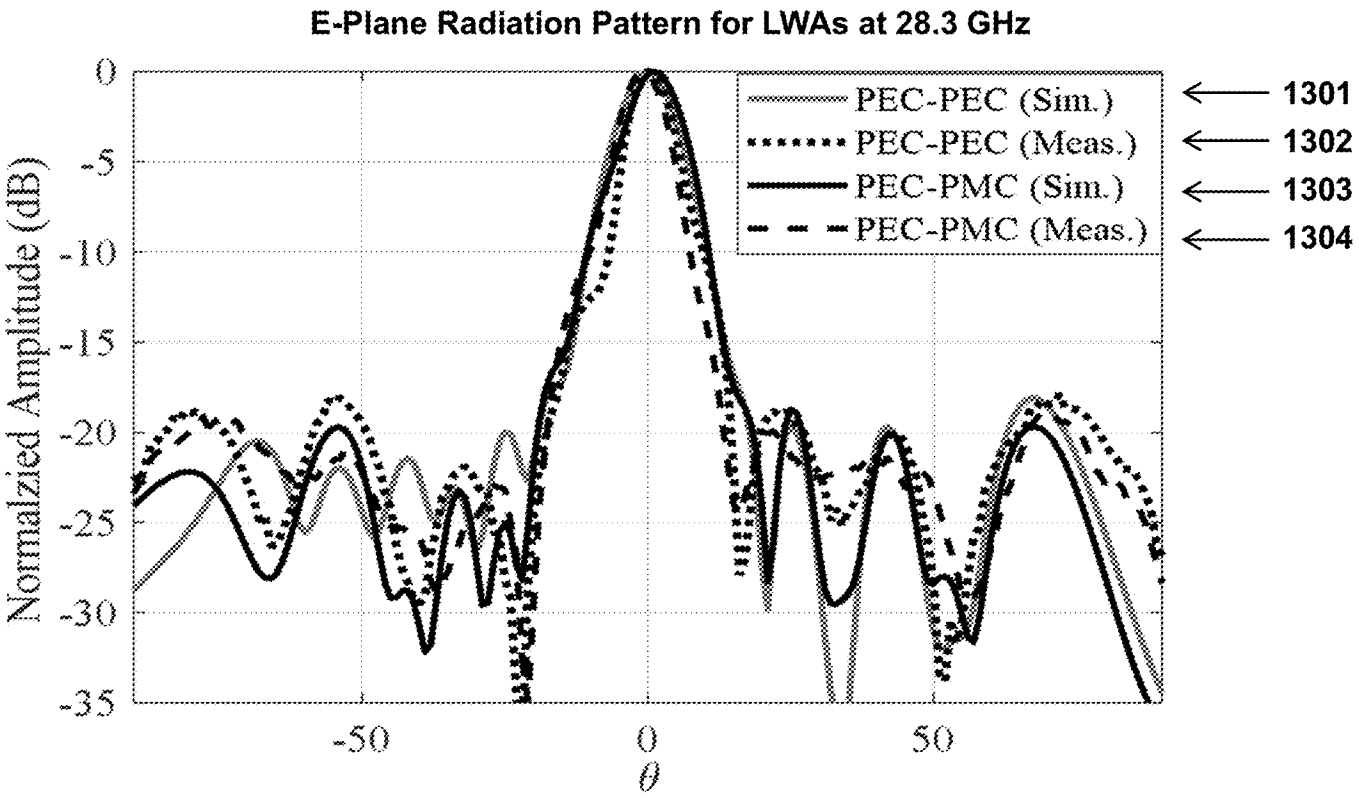
Figure 13D:
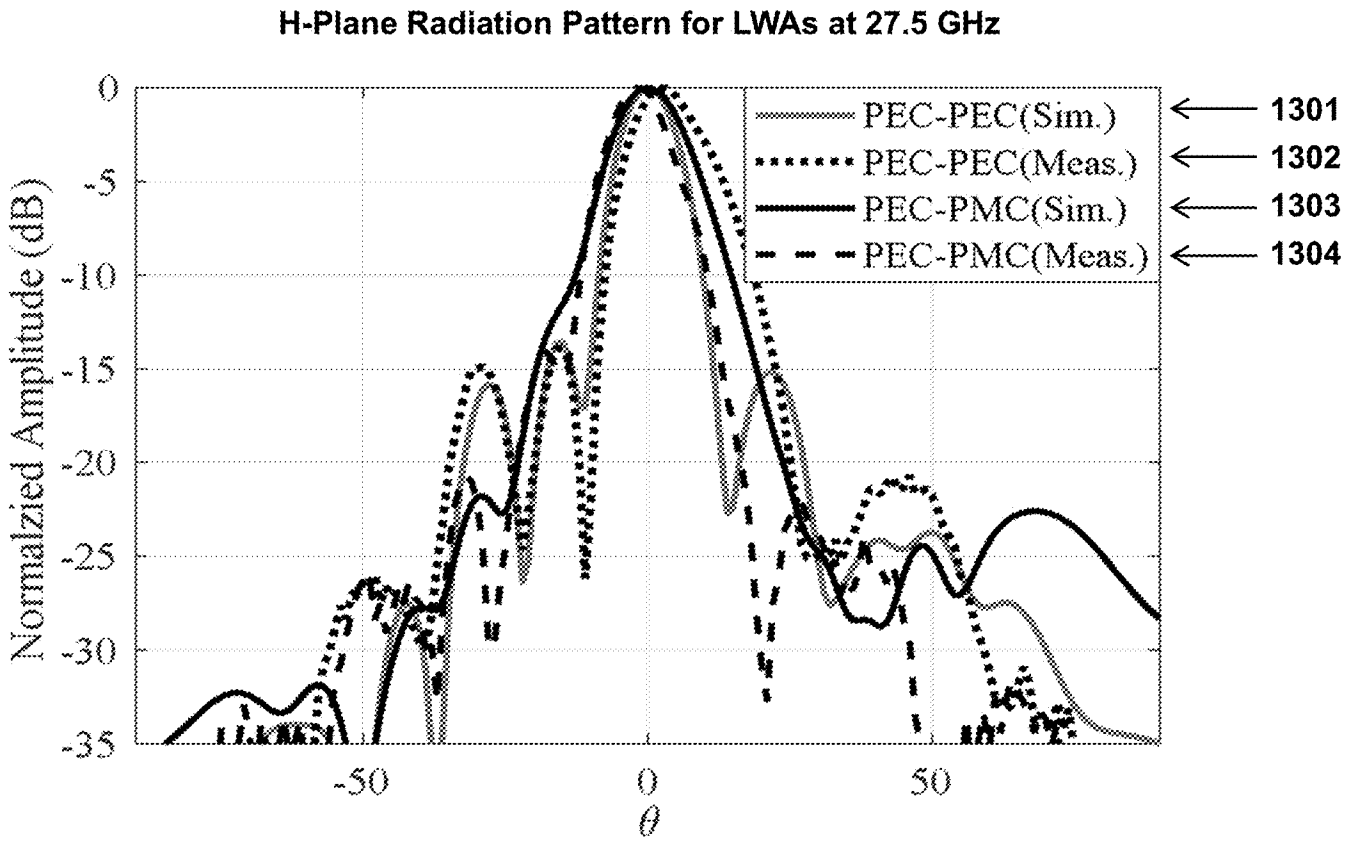
Figure 13E:
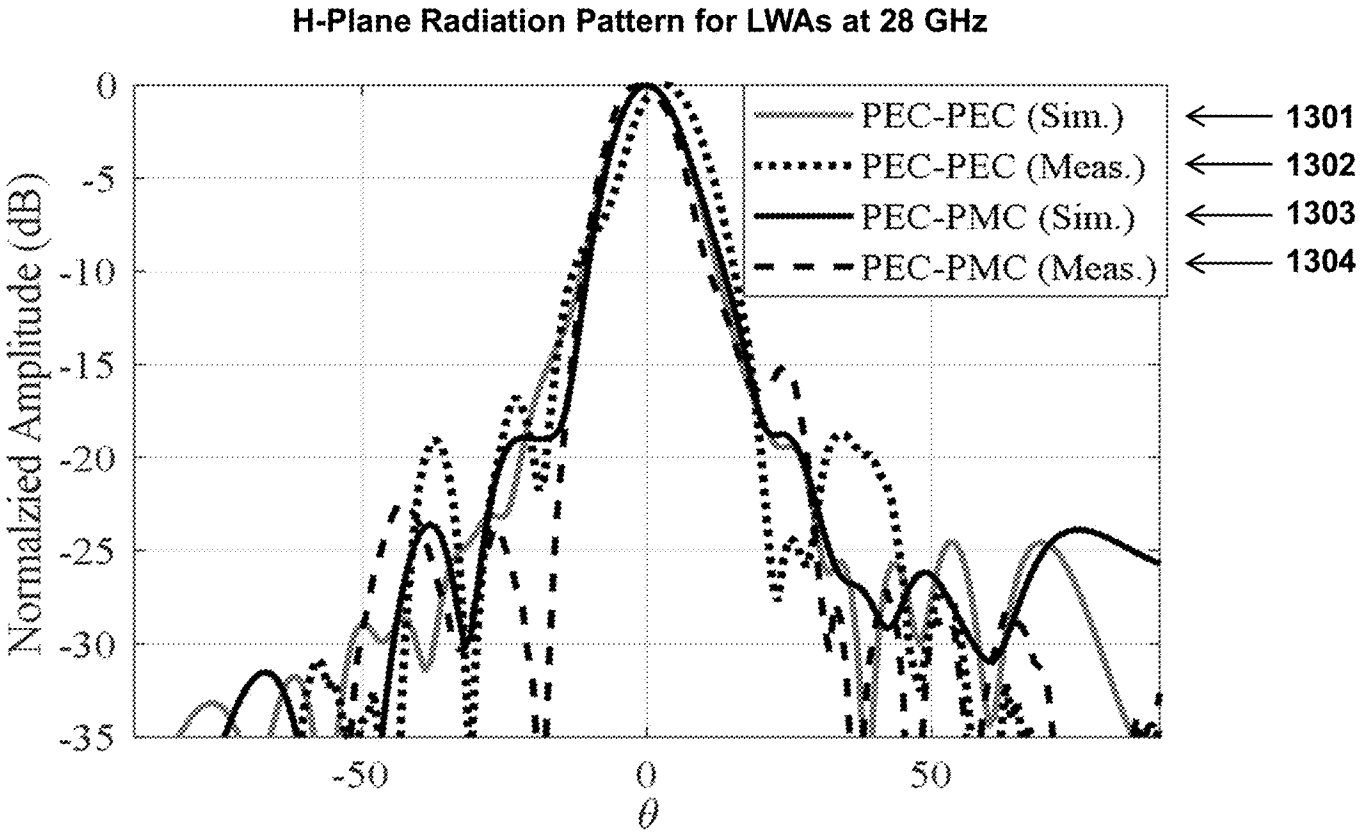
Figure 13F:
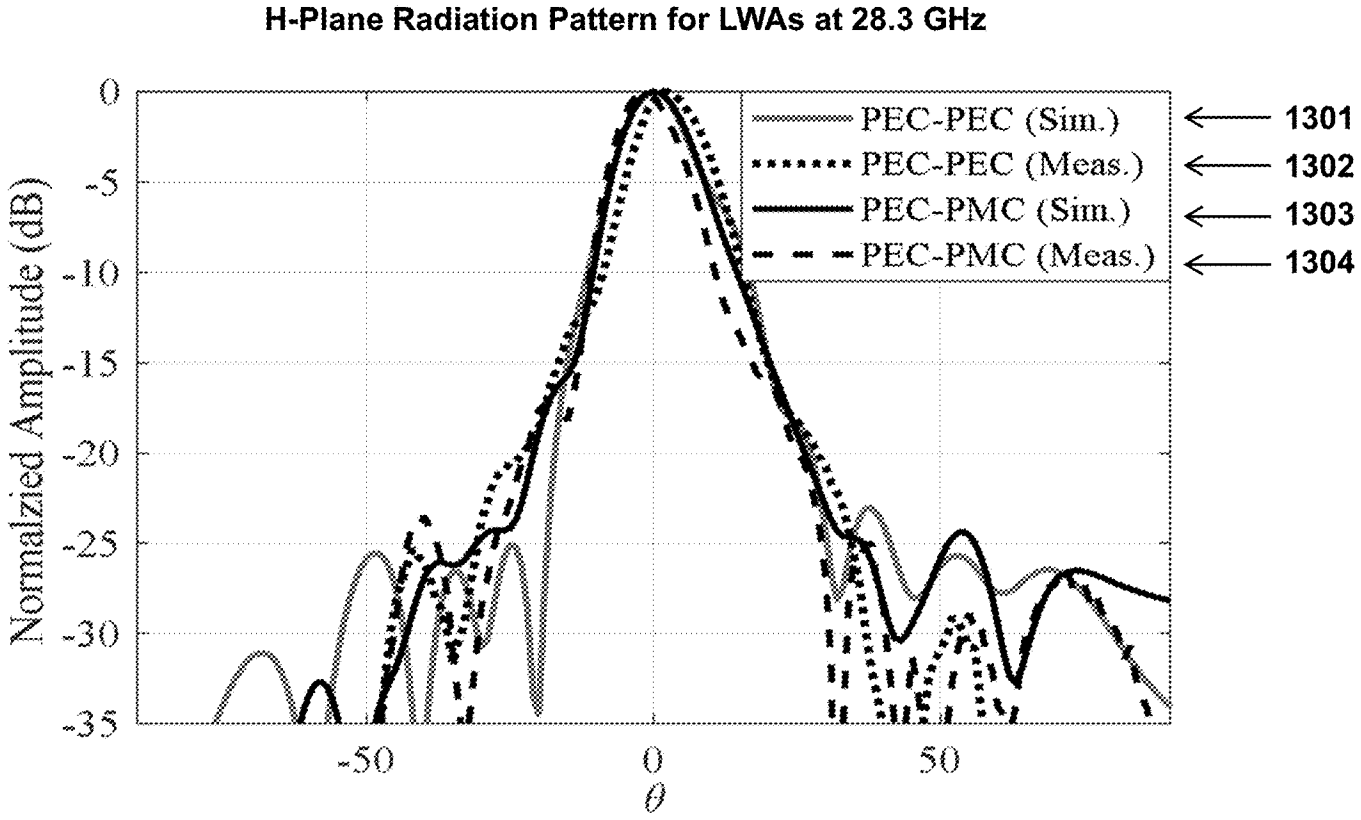

FIGS. 13A to 13F illustrate normalized simulated and measured radiation patterns of two types of the proposed LWAs (e.g. LWA embedded with two PEC reflectors and LWA embedded with PEC-PMC reflectors) at three different frequencies, in accordance with embodiments of the present invention. The radiation patterns of the antennas can be measured in a compact range anechoic chamber for the antenna principle planes. Referring to FIG. 13, both antennas with the PEC-PEC and PEC-PMC reflectors are showing similar patterns in E-plane(s) and H-plane(s) and they have a good agreement with the measured patterns. In more detail, FIGS. 13A to 13F illustrate simulated radiation patterns 1301 for antenna with PEC-PEC reflectors, measured radiation patterns 1302 for antenna with PEC-PEC reflectors, simulated radiation patterns 1303 for antenna with PEC-PMC reflectors, and measured radiation patterns 1304 for antenna with PEC-PMC reflectors. FIG. 13A illustrates E-plane radiation patterns at 27.5 GHz, FIG. 13B illustrates E-plane radiation patterns at 28 GHz and FIG. 13C illustrates E-plane radiation patterns at 28.3 GHz. FIG. 13D illustrates H-plane radiation patterns at 27.5 GHz, FIG. 13E illustrates H-plane radiation patterns at 28 GHz and FIG. 13F illustrates H-plane radiation patterns at 28.3 GHz.

The long transverse slots in front of the reflectors provide a narrow radiation pattern in H-plane. The use of the tapered configuration of the slots illustrated in FIG. 5A has suppressed the high side lobe levels which would appear if the uniform width slots were used. The level of side lobes is higher at broadside frequencies of the periodic uniform slots and that is the reason of having high lobes at the E-plane of 27.5 GHz, which are already decreased through tapering.

According to embodiments, several fabrication limitations have been dealt with to reach an optimum design of these antennas with acceptable performance. For instance, the minimum width of the slot that can be fabricated with our facilities is 0.15 mm, which limits the usage of fine tapering functions on the slot widths. As the antenna structure is not symmetric in H-plane due to the feeding network in the same layer, some asymmetries may be seen around the H-plane pattern. In addition, minor asymmetries in the E-plane pattern of the antenna with the PEC-PMC reflectors may be also expected due to antenna geometry and imperfect PMC boundary conditions.

Figure 14:
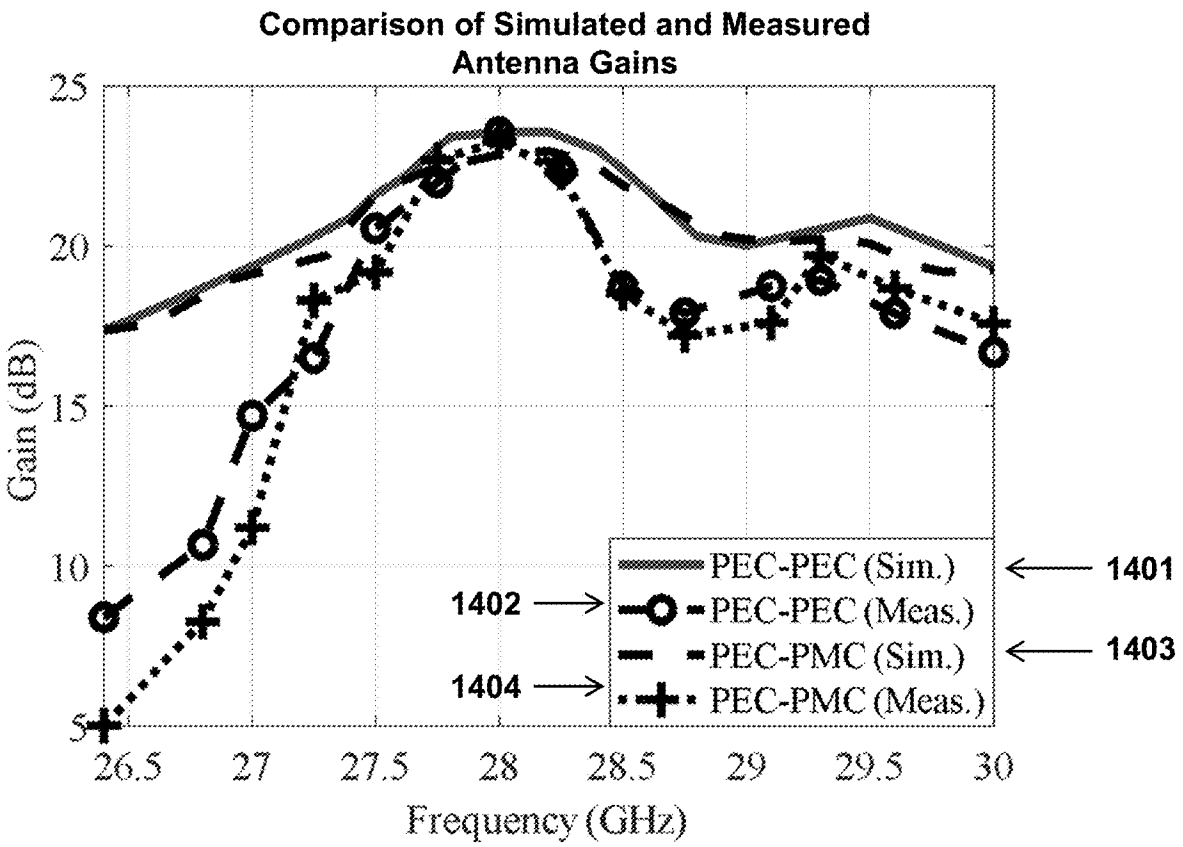
FIG. 14 illustrates simulated and measured gains of the antennas of FIGS. 8A and 9, in accordance with embodiments of the present invention.

FIG. 14 illustrates simulated and measured gains of the antennas, in accordance with embodiments of the present invention. Referring to FIG. 14, the antennas deliver a higher gain performance between 21 to 23 dB in the frequency range of 27.5 to 28.4 GHz since the reflected waves from the reflectors are contributing to provide a single directive beam. As stated above, this band starts immediately after open stopband of the periodic structure in which the propagating mode starts radiating. The antenna beamwidth over this band is wider than the broadside frequencies of periodic slots but the gain is higher because the propagating waves are radiating instead of standing inside the antenna. The antenna with PEC reflectors generally shows a better gain over the band. However, the phase shifting provided by using PEC and PMC reflectors does not have any bandwidth limitation, therefore, the PEC-PMC configuration of the reflectors can be used for any frequency bands and only the slots periodicity has to be modified to obtain a single directive beam. Nevertheless, the slot shifting in the PEC-PEC reflectors configuration has to be fine-tuned to reach an optimum performance in the middle of the band. In more detail, FIG. 14 illustrates simulated antenna gain 1401 for antenna with PEC-PEC reflectors, measured antenna gain 1402 for antenna with PEC-PEC reflectors, simulated antenna gain 1403 for antenna with PEC-PMC reflectors, and measured antenna gain 1404 for antenna with PEC-PMC reflectors.

Technical Benefits

The following technical benefits may potentially be achieved by at least some embodiments of the present invention. With the presented antenna design, a high gain broadside radiation pattern can potentially be achieved with a simple geometry and single layer configuration. The periodicity of radiating slots is providing a narrow broadside beam in E-plane and the extended length of slots provides a narrow beam width associated with the H-plane. The proposed configuration of exciting the periodic radiating elements of leaky-wave structure provides the LWA with broadside radiation outside of its open stopband.

By the aim of the proposed design, a broadside radiation can potentially be achieved from the leaky-wave antenna without adding more complexity to the antenna design or modifying the unit cells structure. Unlike the traditional array methods of acquiring unique directive beam with complicated feeding network, this solution provides the leaky wave structures with a broadside fixed directive beam over a specific bandwidth.

In addition, the whole design of the antenna including radiating elements, integrated reflectors, and horn feeds may be implemented in a single layer substrate with a planar structure which can be considered as another advantage of the design.

The single layer design of this antenna potentially makes it more reliable for mass production which can be easily integrated with supporting circuits and mechanical segments of the system.

In some embodiments, the proposed designs of the LWA can be modified to be implemented in double layers to reach a compact configuration of the antenna in which the radiating slots and the feeding layer can be separated.

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations or equivalents that fall within the scope of the present invention.

What is claimed is:

1. An antenna comprising:

a leaky wave structure having a first end and a second end opposite the first end;

a feeding system comprising a first part and a second part, the first part comprising an approximately perfect electrical conductor (PEC) reflector, and the first part configured to direct a first signal to or from the first end of the leaky wave structure; and the second part comprising an approximately perfect magnetic conductor (PMC) reflector, and the second part configured to direct a second signal to or from the second end of the leaky wave structure, the second signal being an anti-phase version of the first signal.

2. The antenna of claim 1, wherein:

the first signal and the second signal originate or terminate at a common feed point of the antenna;

a total path length of the first part, between the common feed point and the first end of the leaky wave structure is equal to a total path length of the second part, between the common feed point of the antenna and the second end of the leaky wave structure; and wherein the second signal is caused to be the anti-phase version of the first signal due to inherently different operating properties of the PEC reflector relative to the PMC reflector.

3. The antenna of claim 1, wherein the PEC reflector is spaced apart from the first end of the leaky wave structure by a first distance, the PMC reflector is spaced apart from the second end of the leaky wave structure by a second distance, and wherein the first distance is equal to the second distance.

4. The antenna of claim 1, wherein the antenna is formed from a layered structure having an upper conductive layer, a lower conductive layer, and a dielectric layer between the upper conductive layer and the lower conductive layer, and wherein the PMC reflector is provided as a shaped boundary formed in the layered structure, with a region absent of the layered structure located on one side of the shaped boundary.

5. The antenna of claim 4, wherein the PEC reflector is provided by a pattern of plated vias or slots having conductive boundaries and formed within an interior of the layered structure, passing from the upper conductive layer to the lower conductive layer.

6. The antenna of claim 1, wherein the PEC reflector and the PMC reflector are curved reflectors.

7. The antenna of claim 1, wherein the leaky wave structure comprises a waveguide having a plurality of slots formed therein, and wherein widths of the slots progressively increase toward a location of the leaky wave structure midway between the first end and the second end.

8. The antenna of claim 7, wherein the slots are transverse or diagonally transverse to a main axis extending between the first end and the second end.

9. The antenna of claim 8, wherein, the slots are diagonally transverse and wherein at least two of the slots are diagonally transverse in different directions and cross one another.

10. The antenna of claim 1, further comprising a feed point for coupling the antenna to a transmission line, and a power divider coupled to the feed point, the feed point configured to convey a common signal to or from the antenna via both the first part and the second part of the feeding system, and wherein:

the first part comprises: a first arm of the power divider; a first feed horn coupled to the first arm; and a first reflector coupled to the first feed horn; and the second part comprises: a second arm of the power divider; a second feed horn coupled to the second arm; and a second reflector coupled to the second feed horn.

11. The antenna of claim 10, wherein:

a first portion of the common signal is routed, via the first part, between the feed point and the PEC reflector;

a second portion of the common signal is routed, via the second part, between the feed point and the PMC reflector;

the first portion and the second portion of the common signal are in phase with one another;

the first portion of the common signal generates or is derived from the first signal;

the second portion of the common signal generates or is derived from the second signal; and the positioning, configuration, or both, of the PEC reflector and the PMC reflector, are configured to cause the second signal to be the approximately anti-phase version of the first signal.

12. The antenna of claim 10, wherein the feed point, the power divider, the leaky wave structure, the first part, and the second part, are all formed in a common layer of a lithographic layer structure.

13. The antenna of claim 1, wherein the leaky wave structure, the first part, and the second part, are all formed in a common planar portion of a lithographic layer structure.

14. The antenna of claim 13, wherein the common planar portion is formed from a layered structure having an upper conductive layer, a lower conductive layer, and a dielectric layer between the upper conductive layer and the lower conductive layer, and wherein the leaky wave structure, the first part, and the second part are provided by patterning of at least the upper conductive layer.

15. An antenna comprising:

a leaky wave structure having a first end and a second end opposite the first end;

a feeding system comprising a first part and a second part, the first part configured to direct a first signal to or from the first end of the leaky wave structure; and the second part configured to direct a second signal to or from the second end of the leaky wave structure, the second signal being an anti-phase version of the first signal, wherein:

the first part and the second part are coupled to a common feed point of the antenna;

the first part comprises a first reflector formed as an approximately perfect electrical conductor (PEC); and the second part comprises a second reflector formed as an approximately perfect magnetic conductor (PMC).

16. The antenna of claim 15, wherein the first reflector is spaced apart from the first end of the leaky wave structure by a first distance, the second reflector is spaced apart from the second end of the leaky wave structure by a second distance, and wherein the first distance is equal to the second distance.

17. The antenna of claim 15, wherein the first reflector is spaced apart from the first end of the leaky wave structure by a first distance, the second reflector is spaced apart from the second end of the leaky wave structure by a second distance, and wherein the first distance differs from the second distance by an integer multiple of an operating wavelength of the antenna.

18. The antenna of claim 15, wherein the antenna is formed from a layered structure having an upper conductive layer, a lower conductive layer, and a dielectric layer between the upper conductive layer and the lower conductive layer, and wherein the second reflector is provided as a shaped boundary formed in the layered structure, with a region absent of the layered structure located on one side of the shaped boundary.

19. The antenna of claim 18, wherein the first reflector is provided by a pattern of plated vias or slots having conductive boundaries and formed within an interior of the layered structure, passing from the upper conductive layer to the lower conductive layer.

20. The antenna of claim 15, wherein the first reflector and the second reflector are curved reflectors.

21. An antenna comprising:

a leaky wave structure having a first end and a second end opposite the first end;

a feeding system comprising a first part and a second part, the first part configured to direct a first signal to or from the first end of the leaky wave structure; and the second part configured to direct a second signal to or from the second end of the leaky wave structure, the second signal being an anti-phase version of the first signal, wherein:

the first part comprises a first reflector formed as an approximately perfect electrical conductor (PEC), the first reflector spaced apart from the first end of the leaky wave structure by a first distance; and the second part comprises a second reflector formed as another approximately perfect electrical conductor (PEC), the second reflector spaced apart from the second end of the leaky wave structure by a second distance;

wherein the leaky wave structure and a feed point of the antenna are formed in a common planar portion of a lithographic layer structure.

22. The antenna of claim 21, wherein the first distance is greater than the second distance by one half of an operating wavelength of the antenna, or wherein the first distance differs from the second distance by an integer multiple of the operating wavelength minus one half of the operating wavelength.

23. An antenna comprising:

a leaky wave structure having a first end and a second end opposite the first end;

a feeding system comprising a first part and a second part, the first part configured to direct a first signal to or from the first end of the leaky wave structure; and the second part configured to direct a second signal to or from the second end of the leaky wave structure, the second signal being an anti-phase version of the first signal, wherein:

the first part comprises a first reflector, the second part comprises a second reflector;

the first reflector and the second reflector are both formed as approximately perfect electrical conductors (PEC), or the first reflector and the second reflector are both formed as approximately perfect magnetic conductors (PMC);

a total path length of the first part, between a feed point of the antenna and the first end of the leaky wave structure is greater, by one half of an operating wavelength, than a total path length of the second part, between the feed point of the antenna and the second end of the leaky wave structure; and the leaky wave structure and the feed point of the antenna are formed in a common planar portion of a lithographic layer structure.

24. The antenna of claim 23, wherein the antenna is formed from a layered structure having an upper conductive layer, a lower conductive layer, and a dielectric layer between the upper conductive layer and the lower conductive layer, and wherein the first reflector, the second reflector, or both, are provided by a pattern of plated vias or slots having conductive boundaries and formed within an interior of the layered structure, passing from the upper conductive layer to the lower conductive layer.

25. The antenna of claim 23, wherein the first reflector and the second reflector are curved reflectors.

26. An antenna comprising:

a leaky wave structure having a first end and a second end opposite the first end;

a feeding system comprising a first part and a second part, the first part configured to direct a first signal to or from the first end of the leaky wave structure; and the second part configured to direct a second signal to or from the second end of the leaky wave structure, the second signal being an anti-phase version of the first signal, wherein the leaky wave structure comprises a waveguide having a plurality of slots formed therein, the slots being, diagonally transverse, or crossed diagonally transverse to a main axis extending between the first end and the second end, and wherein widths of the slots progressively increase toward a location of the leaky wave structure midway between the first end and the second end.

27. An antenna comprising:

a leaky wave structure having a first end and a second end opposite the first end;

a feeding system comprising a first part and a second part, the first part configured to direct a first signal to or from the first end of the leaky wave structure; and the second part configured to direct a second signal to or from the second end of the leaky wave structure, the second signal being an anti-phase version of the first signal, the antenna further comprising a feed point for coupling the antenna to a transmission line, and a power divider coupled to the feed point, the feed point configured to convey a common signal to or from the antenna, and wherein:

the first part comprises: a first arm of the power divider; a first feed horn coupled to the first arm; and a first reflector coupled to the first feed horn;

the second part comprises: a second arm of the power divider; a second feed horn coupled to the second arm; and a second reflector coupled to the second feed horn; and the leaky wave structure and the feed point of the antenna are formed in a common planar portion of a lithographic layer structure.

28. The antenna of claim 27, wherein:

a first portion of the common signal is routed, via the first part, between the feed point and the first reflector;

a second portion of the common signal is routed, via the second part, between the feed point and the second reflector;

the first portion and the second portion of the common signal are in phase with one another;

the first portion of the common signal generates or is derived from the first signal;

the second portion of the common signal generates or is derived from the second signal; and the positioning, configuration, or both, of the first reflector and the second reflector, are configured to cause the second signal to be the approximately anti-phase version of the first signal.

29. The antenna of claim 27, wherein the feed point, the power divider, the leaky wave structure, the first part, and the second part, are all formed in a common layer of a lithographic layer structure.

30. An antenna comprising:

a leaky wave structure having a first end and a second end opposite the first end;

a feeding system comprising a first part and a second part, the first part configured to direct a first signal to or from the first end of the leaky wave structure; and the second part configured to direct a second signal to or from the second end of the leaky wave structure, the second signal being an anti-phase version of the first signal, wherein the leaky wave structure, and a feed point of the antenna are formed in a common planar portion of a lithographic layer structure.

31. The antenna of claim 30, wherein the common planar portion is formed from a layered structure having an upper conductive layer, a lower conductive layer, and a dielectric layer between the upper conductive layer and the lower conductive layer, and wherein the leaky wave structure, the first part, and the second part are provided by patterning of at least the upper conductive layer.

* * * * *